US012745837B2

(12) United States Patent
Eberlein et al.

(10) Patent No.: US 12,745,837 B2
(45) Date of Patent: Sep. 29, 2026

(54) CONFERENCE TABLE AND COMPONENTS AND METHOD FOR THE USE THEREOF

(71) Applicant: Steelcase Inc., Grand Rapids, MI (US)

(72) Inventors: David Eberlein, Hudsonville, MI (US); Gregory F. Goosen, Grand Rapids, MI (US); Joseph Ted Iacovoni, Caledonia, MI (US); Andrew Davis Edge, Grand Rapids, MI (US); Daniel Paulucci, Grandville, MI (US)

(73) Assignee: Steelcase Inc., Grand Rapids, MI (US)

( * ) Notice: Subject to any disclaimer, the term of this patent is extended or adjusted under 35 U.S.C. 154(b) by 132 days.

(21) Appl. No.: 18/740,879

(22) Filed: Jun. 12, 2024

(65) Prior Publication Data

US 2024/0415278 A1 Dec. 19, 2024

Related U.S. Application Data

(60) Provisional application No. 63/472,984, filed on Jun. 14, 2023.

(51) Int. Cl.

| | |
|---|---|
| ***A47B 13/02*** | (2006.01) |
| ***A47B 13/08*** | (2006.01) |
| ***A47B 21/06*** | (2006.01) |

(52) U.S. Cl.

CPC ..... *A47B 13/023* (2013.01); *A47B 13/088* (2013.01); *A47B 21/06* (2013.01); *A47B 2021/066* (2013.01); *A47B 2200/0082* (2013.01)

(58) Field of Classification Search

CPC ..... A47B 13/08; A47B 13/023; A47B 13/088; A47B 21/06; A47B 2021/066; A47B 2021/068; A47B 2200/0082

See application file for complete search history.

(56) References Cited

U.S. PATENT DOCUMENTS

| | | | |
|---|---|---|---|
| 1,158,125 | A | 10/1915 | Fink |
| 1,384,925 | A | 7/1921 | Seiler |

(Continued)

FOREIGN PATENT DOCUMENTS

| | | | |
|---|---|---|---|
| CN | 307567 | B1 | 3/1989 |
| CN | 101630827 | A | 1/2010 |

(Continued)

OTHER PUBLICATIONS

International Search Report and Written Opinion issued in International Patent Application No. PCT/ US2024/033627, mailing date Oct. 23, 2024.

(Continued)

*Primary Examiner* — Daniel J Rohrhoff

(74) *Attorney, Agent, or Firm* — Benesch Friedlander Coplan & Aronoff LLP

(57) ABSTRACT

A conference table includes a base and a worksurface supported by the base. The worksurface has a peripheral edge and an aperture having a node and at least three branches extending radially outwardly from the node. The base has a peripheral wall defining an interior space, an opening and a panel moveable between an open position wherein the interior space is accessible through the opening and a closed position wherein the panel is disposed over the opening. One or more electronic components may be coupled to the panel. A cable retention device may be coupled to a utility cable above the worksurface. The cable retention device includes an inlet formed in a peripheral side, a first outlet in communication with the inlet and formed in the peripheral side at a location spaced apart from the inlet, and a second outlet in communication with the inlet and formed in a bottom.

19 Claims, 16 Drawing Sheets

(56) References Cited

U.S. PATENT DOCUMENTS 1,547,685 A 7/1925 Rhodes
1,618,901 A 2/1927 Woolman
1,645,250 A 10/1927 Mitchell
2,536,511 A 1/1951 Megies
2,540,291 A 2/1951 Reingold
2,703,740 A 3/1955 Cochard
D194,468 S 1/1963 Goodman
D196,121 S 8/1963 Soszynski
3,120,405 A 2/1964 Soszynski
D206,998 S 2/1967 Benjamin
D209,911 S 1/1968 Cooper
3,477,760 A 11/1969 Bue et al.
3,683,825 A 8/1972 Sheldon
4,069,770 A 1/1978 Bertelsen
4,323,291 A 4/1982 Ball
4,378,468 A 3/1983 Braun
4,400,724 A 8/1983 Fields
D272,302 S 1/1984 Connelly
D274,581 S 7/1984 Gallock
4,475,649 A 10/1984 Haarbosch
4,612,717 A 9/1986 Alvarez
4,758,887 A 7/1988 Engel et al.
4,792,881 A 12/1988 Wilson et al.
4,836,114 A 6/1989 Cohen
5,065,964 A 11/1991 Polak
D327,178 S 6/1992 Ryaa
5,121,698 A 6/1992 Kelley
5,156,095 A 10/1992 Hansback et al.
5,159,445 A 10/1992 Gitlin et al.
5,194,955 A 3/1993 Yoneta et al.
D337,000 S 7/1993 Williams
5,231,562 A * 7/1993 Pierce ..... H02B 1/26 108/50.02
5,237,937 A 8/1993 Peltier et al.
D339,487 S 9/1993 Rizzi
5,243,413 A 9/1993 Gitlin et al.
5,282,027 A 1/1994 Tanigaki et al.
D352,182 S 11/1994 Yoshimura
5,400,069 A 3/1995 Braun et al.
5,406,323 A 4/1995 Tanigaki et al.
5,421,271 A 6/1995 Sui
5,448,287 A 9/1995 Hull
5,470,128 A 11/1995 Kerkham
5,567,916 A 10/1996 Napiorkowski et al.
5,612,733 A 3/1997 Flohr
5,619,254 A 4/1997 McNelley
5,636,822 A * 6/1997 Hendershot ..... G06F 3/0395 248/51
5,676,068 A 10/1997 Kallander
5,727,343 A 3/1998 Wehner et al.
5,808,663 A 9/1998 Okaya
5,844,775 A 12/1998 Lundberg
D409,008 S 5/1999 Lunn
5,901,930 A 5/1999 Harrel
5,953,052 A 9/1999 McNelley et al.
6,009,814 A 1/2000 Rossi
6,012,398 A 1/2000 Boyce
6,037,970 A 3/2000 Kondo
6,076,474 A 6/2000 Grabowski et al.
6,079,676 A 6/2000 Hackett et al.
D434,738 S 12/2000 Takemasa
6,160,573 A 12/2000 Allen et al.
6,176,561 B1 1/2001 Roels et al.
6,243,130 B1 6/2001 McNelley et al.
D447,365 S 9/2001 Chi
6,283,043 B1 * 9/2001 Stern ..... A47B 21/00 108/50.02
6,327,983 B1 12/2001 Cronk et al.
D456,645 S 5/2002 Iverson
6,435,106 B2 8/2002 Funk et al.
6,455,776 B1 9/2002 Milne
6,550,921 B1 4/2003 Monson
D474,454 S 5/2003 Izu et al.
6,606,111 B1 8/2003 Kondo et al.
D482,536 S 11/2003 Williams
6,732,660 B2 5/2004 Dame et al.
6,798,441 B2 9/2004 Hartman et al.
6,895,634 B2 5/2005 Tisbo
6,994,032 B2 2/2006 Conley et al.
7,077,464 B2 7/2006 Ford et al.
7,092,002 B2 8/2006 Ferren et al.
7,119,829 B2 10/2006 Leonartd et al.
7,126,627 B1 10/2006 Lewis et al.
D542,243 S 5/2007 Lewis
7,278,360 B2 10/2007 Griepentrog
7,311,047 B2 12/2007 Conley et al.
7,352,809 B2 4/2008 Wenger et al.
7,357,086 B2 4/2008 Petrick
D572,918 S 7/2008 Viets
7,455,018 B2 11/2008 Conley et al.
7,464,653 B2 12/2008 Dodge
D588,560 S 3/2009 Mellingen et al.
D588,825 S 3/2009 van Ierssel
7,515,174 B1 4/2009 Francisco et al.
7,558,823 B2 7/2009 Beers et al.
7,679,639 B2 3/2010 Harrell et al.
7,707,247 B2 4/2010 Dunn et al.
D615,514 S 5/2010 Mellingen et al.
7,710,448 B2 5/2010 De Beer et al.
7,710,450 B2 5/2010 Dhuey et al.
7,746,373 B2 6/2010 Martini
7,801,430 B2 9/2010 Gorzynski et al.
D626,103 S 10/2010 Buzzard et al.
D628,175 S 11/2010 Desai et al.
D628,968 S 12/2010 Desai et al.
7,847,814 B2 12/2010 Ferren et al.
7,855,726 B2 12/2010 Ferren et al.
D632,661 S 2/2011 Micallef
7,884,846 B2 2/2011 Ferren et al.
7,884,855 B2 2/2011 Ortiz
7,913,867 B2 3/2011 Phillips
7,916,165 B2 3/2011 Ferren et al.
D637,568 S 5/2011 Desai et al.
8,087,738 B2 1/2012 Henriott et al.
8,130,256 B2 3/2012 Trachtenberg et al.
D659,427 S 5/2012 Nicholas
8,259,155 B2 9/2012 Marathe et al.
8,272,335 B2 * 9/2012 Derocher ..... A47B 97/00 108/50.02
8,276,523 B2 10/2012 Miller et al.
8,289,363 B2 10/2012 Buckler
8,299,979 B2 10/2012 Rambo et al.
8,319,819 B2 11/2012 MacDonald et al.
8,330,791 B2 12/2012 Gorzynski et al.
8,345,082 B2 1/2013 Tysso
8,355,041 B2 1/2013 Chen et al.
8,358,328 B2 1/2013 Friel et al.
8,384,824 B2 2/2013 Miyagawa et al.
8,405,704 B2 3/2013 Kobayashi et al.
8,407,944 B2 4/2013 Baloga et al.
8,446,455 B2 5/2013 Lian et al.
8,456,506 B2 6/2013 Ferren et al.
8,477,175 B2 7/2013 Shaffer et al.
D688,074 S 8/2013 Lin
8,526,632 B2 9/2013 Cutler
8,659,637 B2 2/2014 De Beer et al.
8,675,038 B2 3/2014 Wessling
8,692,862 B2 4/2014 N'Guessan
8,704,867 B2 4/2014 Hubenthal et al.
8,739,363 B2 6/2014 Allen
8,773,495 B2 7/2014 Saleh et al.
8,797,377 B2 8/2014 Mauchly et al.
8,997,661 B1 4/2015 Kilday
8,998,151 B2 4/2015 Hoek
9,058,055 B2 6/2015 Ferren et al.
9,095,209 B2 8/2015 Mirth et al.
9,743,758 B2 8/2017 Johnson et al.
D808,197 S 1/2018 Castaneda Roldan et al.
9,955,318 B1 4/2018 Scheper et al.
10,028,576 B1 * 7/2018 Yao ..... A47B 9/20
10,117,511 B2 11/2018 Gosling et al.
10,130,169 B1 11/2018 Labrosse et al.
D838,129 S 1/2019 Castaneda Roldan et al.
10,219,614 B2 3/2019 Castaneda Roldan et al.

(56) References Cited

U.S. PATENT DOCUMENTS

| | | | | |
|---|---|---|---|---|
| 10,334,943 | B2 | 7/2019 | Brandenberg et al. | |
| 10,492,601 | B2 | 12/2019 | Mirth et al. | |
| 10,631,632 | B2 * | 4/2020 | Epstein | A47B 21/06 |
| 10,638,833 | B1 * | 5/2020 | Brucha | H05K 5/0217 |
| 10,842,266 | B2 | 11/2020 | Matthai et al. | |
| 10,905,230 | B2 | 2/2021 | Summerville | |
| 11,401,132 | B2 | 8/2022 | Smith et al. | |
| 11,406,181 | B2 | 8/2022 | Mulder et al. | |
| 11,457,732 | B2 | 10/2022 | Colin et al. | |
| 11,779,108 | B1 * | 10/2023 | Mirth | A47B 21/06 108/50.02 |
| 2004/0008423 | A1 | 1/2004 | Driscoll, Jr. et al. | |
| 2004/0207718 | A1 | 10/2004 | Boyden et al. | |
| 2004/0216647 | A1 | 11/2004 | Cvek | |
| 2005/0062844 | A1 | 3/2005 | Ferren et al. | |
| 2005/0076469 | A1 * | 4/2005 | Tisbo | H02G 3/083 16/2.1 |
| 2005/0079769 | A1 * | 4/2005 | Strayer | H01R 25/006 439/652 |
| 2005/0263041 | A1 | 12/2005 | Mueller | |
| 2005/0268823 | A1 * | 12/2005 | Bakker | A47B 21/06 108/50.02 |
| 2007/0279483 | A1 | 12/2007 | Beers et al. | |
| 2007/0290531 | A1 | 12/2007 | Larsen | |
| 2008/0115697 | A1 * | 5/2008 | Beam | H04M 1/02 108/26 |
| 2008/0237412 | A1 | 10/2008 | Chinuki et al. | |
| 2008/0276841 | A1 * | 11/2008 | Brauning | A47B 13/02 108/154 |
| 2008/0295743 | A1 | 12/2008 | Beam | |
| 2009/0207233 | A1 | 8/2009 | Mauchly et al. | |
| 2009/0273260 | A1 | 11/2009 | Kemp | |
| 2010/0108674 | A1 | 5/2010 | Phillips | |
| 2010/0118112 | A1 | 5/2010 | Nimri et al. | |
| 2010/0208078 | A1 | 8/2010 | Tian et al. | |
| 2011/0134204 | A1 | 6/2011 | Rodriguez et al. | |
| 2011/0147542 | A1 | 6/2011 | Hoek | |
| 2011/0309659 | A1 | 12/2011 | Beauchamp | |
| 2012/0103235 | A1 * | 5/2012 | Summerville | A47B 1/03 108/89 |
| 2012/0151677 | A1 | 6/2012 | Yesudhas et al. | |
| 2015/0150374 | A1 | 6/2015 | Jones | |
| 2015/0173505 | A1 * | 6/2015 | Mirth | A47B 17/00 211/186 |
| 2015/0295477 | A1 * | 10/2015 | Koizumi | H02K 3/12 310/68 C |
| 2016/0000218 | A1 | 1/2016 | Hsu | |
| 2016/0363310 | A1 * | 12/2016 | Powell | A47B 13/08 |
| 2017/0324230 | A1 * | 11/2017 | Warrilow | A47B 21/06 |
| 2017/0360187 | A1 | 12/2017 | Rossi | |
| 2018/0055216 | A1 * | 3/2018 | Mirth | A47B 21/04 |
| 2019/0150610 | A1 * | 5/2019 | Johnasson | A47B 13/086 |
| 2020/0037756 | A1 | 2/2020 | Lord | |
| 2020/0130982 | A1 | 4/2020 | Smith et al. | |
| 2021/0212453 | A1 * | 7/2021 | Mulder | A47B 21/06 |
| 2022/0279919 | A1 | 9/2022 | Summerville | |
| 2022/0378194 | A1 | 12/2022 | Lin | |
| 2022/0395090 | A1 | 12/2022 | Van Faasen et al. | |

FOREIGN PATENT DOCUMENTS

| | | | |
|---|---|---|---|
| CN | 202010003607 | U1 | 11/2011 |
| CN | 202011103891 | U1 | 1/2012 |
| CN | 2012120795 | A | 6/2012 |
| CN | 2476339 | B1 | 7/2012 |
| CN | 102011008542 | A1 | 7/2012 |
| CN | 102011018758 | A1 | 10/2012 |
| CN | 203152938 | U | 8/2013 |
| CN | 202013105215 | U1 | 1/2014 |
| CN | 203802129 | U | 9/2014 |
| CN | 204635411 | | 9/2015 |
| CN | 204812639 | U | 12/2015 |
| CN | 104665273 | B | 1/2017 |
| CN | 206641560 | U | 11/2017 |
| CN | 20180020506 | A | 2/2018 |
| CN | 102016120021 | A1 | 4/2018 |
| CN | 208403603 | U | 1/2019 |
| CN | 2019076625 | A | 5/2019 |
| CN | 2021037100 | A | 3/2021 |
| CN | 216822237 | U | 6/2022 |
| CN | 217089956 | U | 8/2022 |
| CN | 217185246 | U | 8/2022 |
| DE | 1 243 355 | | 6/1967 |
| DE | 3331 481 | A1 | 3/1985 |
| DE | 87 07 699 | | 8/1987 |
| DE | 42 07 742 | A1 | 9/1993 |
| DE | 296 00 611 | U1 | 3/1996 |
| DE | 10 2008 017 995 | A1 | 10/2009 |
| EP | 0 740 177 | A2 | 10/1996 |
| EP | 1 610 555 | A1 | 12/2005 |
| FR | 2758063 | | 7/1998 |
| GB | 206400 | | 11/1923 |
| GB | 2 353 429 | A | 2/2001 |
| GB | 2 396 552 | A | 6/2004 |
| GB | 2484944 | A | 5/2012 |
| JP | 4-344789 | | 12/1992 |
| JP | 2019-76626 | A | 5/2019 |
| JP | 2024153506 | A | 10/2024 |
| JP | 2024153507 | A | 10/2024 |
| TW | 340324 | | 1/2018 |
| TW | M 618980 | U | 11/2021 |
| WO | WO1998/047291 | | 10/1998 |
| WO | WO2001/22848 | | 4/2001 |
| WO | WO 2006/117445 | A1 | 11/2006 |
| WO | WO2008/101117 | | 8/2008 |
| WO | WO2009/120814 | | 10/2009 |
| WO | WO2010/033036 | | 3/2010 |
| WO | WO2010/104765 | | 9/2010 |
| WO | WO2012/001017 | | 1/2012 |
| WO | WO 2018/068109 | A1 | 4/2018 |

OTHER PUBLICATIONS

Paul Downs. Custom Conference Tables. Internet. May 30, 2023. [Retrieved on Sep. 12, 2024]. Retrieved from internet: <URL: https://web.archive.org/web/20230530104757/https://www.custom-conference-tables.com/about-tables/other-conference-table-materials l> pp. 1-8.

Heili Power. Power Track. YouTube. Nov. 2, 2020. [Retrieved on Sep. 12, 2024]. Retrieved from internet: <URL: https://www.youtube.com/watch?v=ILMioqWj8KE>. entire video.

CableOrganizer®, "What is a Desk Grommet & How Do I Choose One?" Date: Before Jun. 14, 2023, (3 pages).

Caretta Workspaces, "Cable Management"Date: Before Jun. 14, 2023, (7 pages).

B Bit Usa, "B Fit Gym Machine Cable Ball Stopper—Universal Size B 36" Date: Before Jun. 14, 2023, (4 pages).

Chrome Cherry Design & Innovation, "Cable Pod" Date: Before Jun. 14, 2023, (25 pages).

Parsons Home Appliances and Furnishers, Home office, Date: Before Jun. 14, 2023, (15 pages).

Cable Management Make Tangled Wires and Cables Disappear, Date: Before Jun. 14, 2023, (1 page).

Box Base Boardroom Table, Date: Before Jun. 14, 2023, (1 page).

* cited by examiner

CONFERENCE TABLE AND COMPONENTS AND METHOD FOR THE USE THEREOF

This application claims the benefit of U.S. Provisional Application No. 63/472,984, filed Jun. 14, 2023 and entitled "Conference Table and Components and Method for the Use Thereof," the entire disclosure of which is hereby incorporated herein by reference.

FIELD OF THE INVENTION

The present disclosure relates generally to a conference table and components, and to methods for the use, assembly and reconfiguration thereof.

BACKGROUND

Workspace systems are often configured with one or more cameras and/or displays allowing people at remote locations to interface with on-site workers in a workspace. The on-site workers typically gather about a conference table, such that work papers and electronic devices may be easily viewed and accessed while conducting a conference call or video meeting. The conference tables are not often suitably shaped to accommodate the on-site workers in a proper viewing configuration. In addition, technology components, including processors, power sources, data storage devices, modems, video transmission equipment, etc., are either exposed, thereby providing an unsightly aesthetic, or are ensconced in a cabinet or structure, wherein the electronic components are not accessible, for example if adjustments and/or maintenance is required.

In addition, the on-site workers will often carry and interact with personal smart devices, or electronic mobile devices, including laptop computers, tablets and smart phones. The on-site workers, however, may not carry with them cords or cables allowing them to power the devices and/or to transmit data to and from the devices. Typically, conference tables may be configured with a power or data outlet, but not a cord or cable interface. Even if a cord or cable is provided, for example by an on-site worker, the cord or cable may fall through an opening in the table, or be pulled out of a port. In addition, worksurfaces configured for videoconferencing, for example with a relatively wide footprint, may not allow the workers at the periphery to reach or access a centrally located power/data source.

SUMMARY

The present invention is defined by the following claims, and nothing in this section should be considered to be a limitation on those claims.

In one aspect, one embodiment of a conference table includes a base and a worksurface supported by the base. The worksurface has a peripheral edge and an aperture having a node and at least three branches extending radially outwardly from the node. Each of the branches has a greatest width, and the node has a width greater than the greatest width of each of the branches. Each of the branches has a proximal end opening into and communicating with the node and a terminal end spaced from the node. Each of the terminal ends is located a distance relative to the peripheral edge of the worksurface permitting a user to access a cable retained at the terminal end, but also discouraging users from inadvertently depositing objects through the aperture. For example, in one embodiment, the terminal ends are located less than or equal to 36 inches from the peripheral edge. In one embodiment, the terminal ends are located at least 6 inches from the peripheral edge.

In one aspect, one embodiment of the conference table has a base including a peripheral wall defining an interior space, an opening and a panel moveable between an open position wherein the interior space is accessible through the opening and a closed position wherein the panel is disposed over the opening. In one embodiment, the panel is pivotally mounted to the peripheral wall. The panel may include a bottom portion pivotally mounted to the peripheral wall about a horizontal axis. The panel may include an outer cover and an inner mounting plate removably coupled to the outer cover, or to the frame, wherein the mounting plate comprises electronic component mounting features. One or more electronic components may be coupled to the mounting features, with a utility cable coupled to the electronic component and extending through the aperture in the worksurface.

In another aspect, one embodiment of a cable retention device includes a housing having a bottom, a peripheral side, a top, an inlet formed in the peripheral side, a first outlet in communication with the inlet and formed in the peripheral side at a location spaced apart from the inlet, and a second outlet in communication with the inlet and formed in the bottom. A utility cable may pass through the second outlet if overlying the aperture, or through the first outlet if not overlying the aperture.

In another aspect, one embodiment of a conference table includes a base having a peripheral wall defining an interior space, an opening in the peripheral wall, and a moveable panel moveable between an open position wherein the interior space is accessible through the opening and a closed position wherein the panel is disposed over the opening. The panel includes an outer cover and an inner mounting plate removably coupled to the outer cover or to the frame, wherein the mounting plate is configured with an electronic component mounting feature. A worksurface includes an upper surface, a bottom surface defining in part the interior space and an aperture communicating between the upper surface and the interior space.

In yet another aspect, one embodiment of a method of using a conference table includes maintaining a connector portion of a utility cable on an upper surface of a worksurface with a pod fixedly connected to the utility cable, wherein the utility cable extends through an aperture in the worksurface and wherein the pod is larger than the aperture. The method further includes moving the pod relative to the upper surface to position the connector portion and thereby moving the utility cable relative to the aperture, positioning an electronic mobile device on a worksurface, and connecting the electronic mobile device to the utility cable The various embodiments of the conference table and cable retention device, and methods for the configuration and use thereof, provide significant advantages over other conference tables, and components used therewith. For example and without limitation, the disclosed components allow for on-site workers to easily power and connect their electronic devices, even when gathered around a conference table configured for video conferencing. The utility cables are maintained on the surface of the worksurface, and may not be easily dislodged, or pulled through an aperture in the table. The configuration of the aperture ensures that the cables are accessible to users positioned around the periphery of the worksurface. The conference table also provides quick and easy access to electronic components stored and mounted in an interior space thereof.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
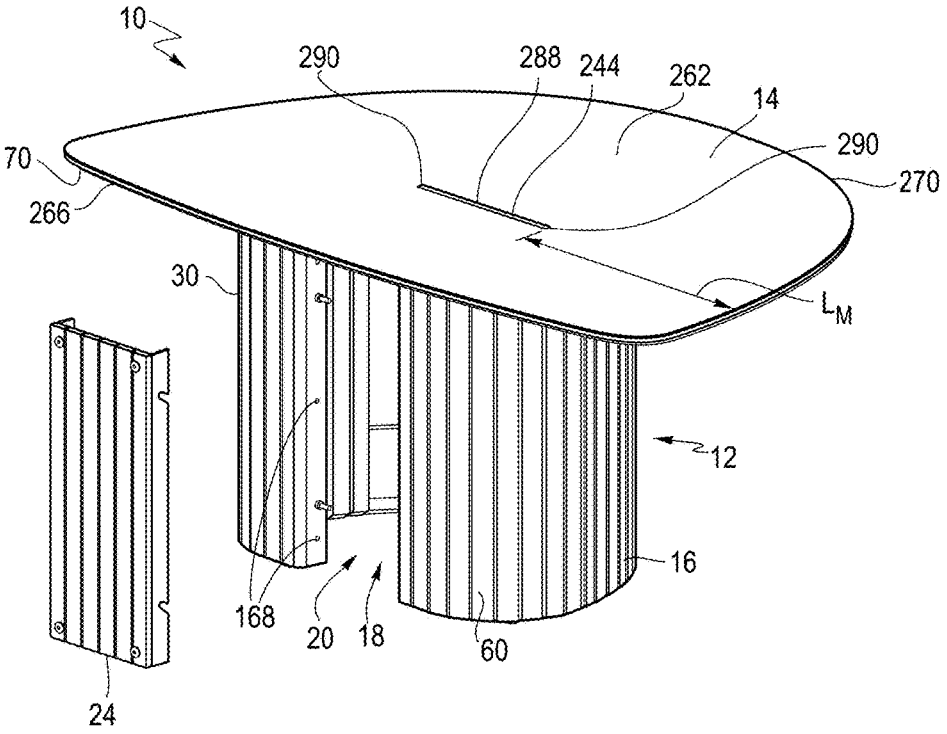
FIG. 1 is a perspective view of one embodiment of a conference table, with a door shown in an exploded configuration.
Figure 2:
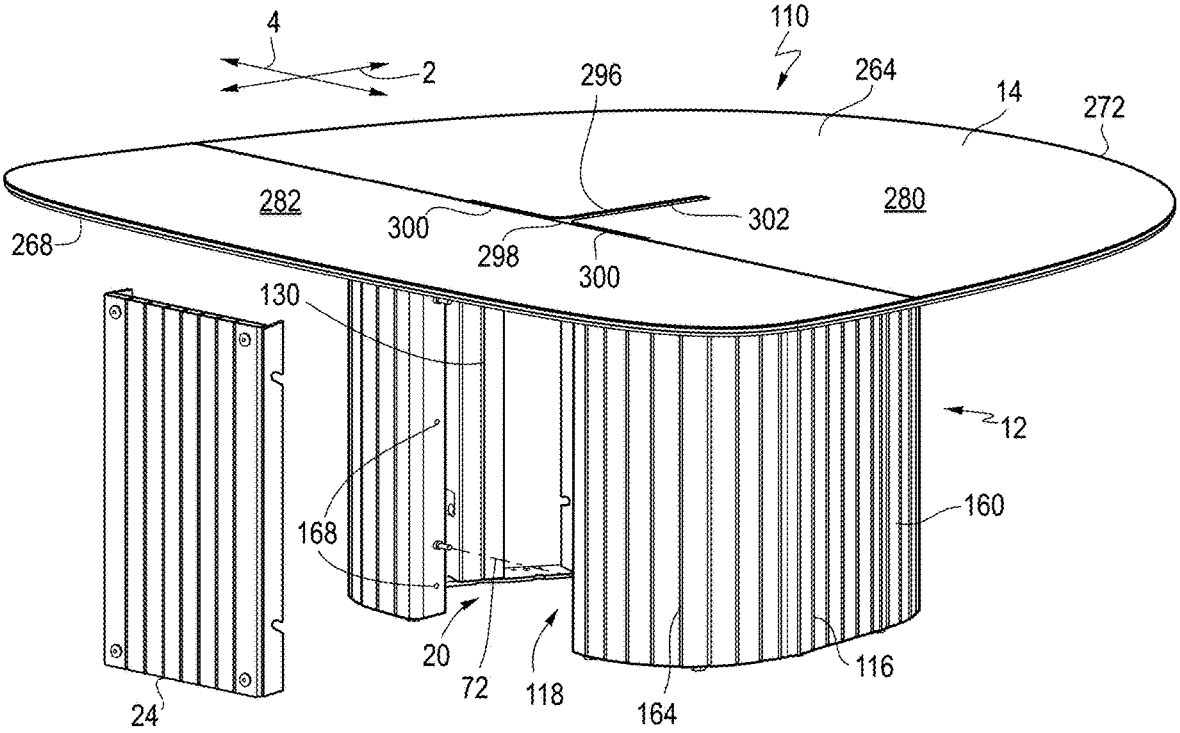
FIG. 2 is a perspective view of another embodiment of a conference table, with a door shown in an exploded view.
Figure 3:
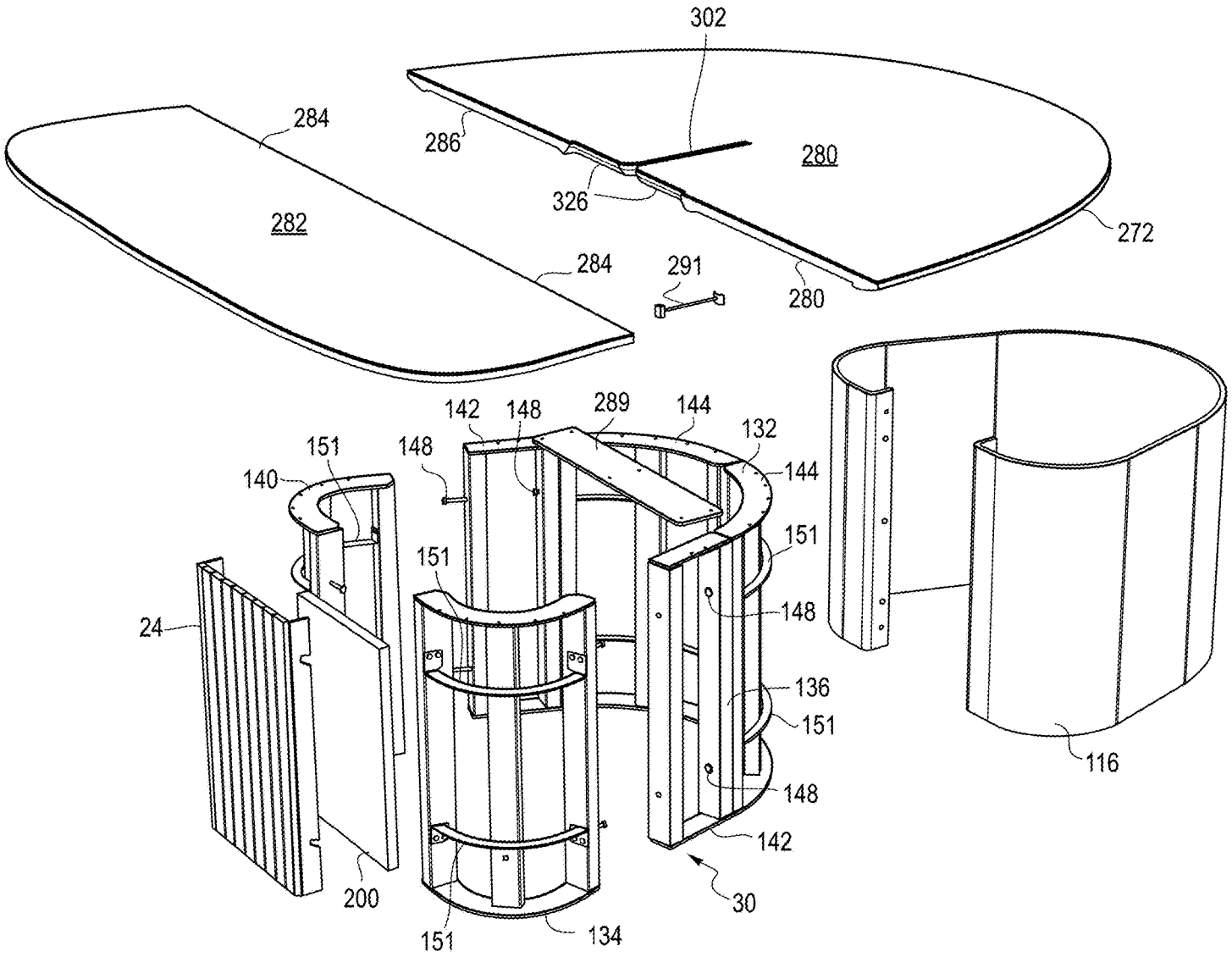
FIG. 3 is an exploded perspective view of the conference table shown in FIG. 2.

It should be understood that the term "plurality," as used herein, means two or more. The terms "longitudinal" as used herein means of or relating to length or the lengthwise direction 2, for example between the opposite ends of a table. The terms "lateral" and "transverse" as used herein, means situated on, directed toward or running from side to side, and refers to a lateral direction 4 transverse to the longitudinal direction. The term "coupled" means connected to or engaged with whether directly or indirectly, for example with an intervening member, and does not require the engagement to be fixed or permanent, although it may be fixed or permanent (or integral), and includes both mechanical and electrical connection. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. For example, a "first" outlet may be later referred to as a "second" outlet depending on the order in which they are referred. It should also be understood that designation of "first" and "second" does not necessarily mean that the two components or values so designated are different, meaning for example a first cable retention device may be the same as a second cable retention device, with each simply being applicable to separate but identical components.

Base:

Referring to FIGS. 1-3 and 6, a conference table 10, 110 includes a base 12, 112 and a worksurface 14, 114 supported by the base. The base 12, 112 includes a peripheral wall 16, 116 defining an interior space 18, 118 and an opening 20, or doorway, providing access to the interior space 18, 118. The peripheral wall 16, 116 may have a variety of different shapes in plan view, including a generally gumdrop shape with a flattened (e.g., linear) rear wall 122, defined in part for example by a moveable panel 24 covering the opening 20, a pair of linear side walls 124 forming an acute angle $\alpha$ with the rear wall 122, two curved corners 126 transitioning between one end of each of the side walls 124 and the rear wall 122 and a curved apex 128 disposed between opposite ends of the side walls 124. The panel 24 is moveable between an open position wherein the interior space 18, 118 is accessible through the opening 20 and a closed position wherein the panel 24 is disposed over the opening 20, 120. The peripheral wall may have other shapes in plan view, including various polygonal, circular or elliptical shapes.

The base 12, 112, and peripheral wall in particular, includes a frame 30, 130 having top and bottom plates 132, 134 and a plurality of spaced apart stiles 136 extending vertically between the plates 132, 134. The frame 130 may include a plurality of modules 140, 142, 144, each having a top and bottom plate section and two or more stiles 136. For example, linear modules 142 may define in part the linear side walls 124, while curved modules 140, 144 may define the curved corners 126 and apex 128. The modules 140, 142, 144 may be coupled, for example by abutting adjacent stiles 136 and clamping them together with bolts 148. Intermediate ribs 151 may be secured to the stiles 136 at locations vertically spaced between the upper and lower plates 132, 134 to provide additional support for a skirt 60, 160. Floor engaging components 162, such as glides or leveling devices, may be mounted to the bottom of the bottom plate for engagement with the floor.

The skirt 60, 160, made for example of polyethylene terephthalate (PET), wraps around the frame 30, 130 and is disposed between the upper and lower plates 132, 134. The skirt may 60, 160 be coupled to the stiles 36 with fasteners, including mechanical fasteners such as screws, snaps or ties, or with adhesive. The skirt 60, 160 may include score lines 164, which do not penetrate the entire depth of the panel, but allow the skirt to bend and conform to the shape of the frame. In one embodiment, the skirt 60, 160 is disposed between lip portions of the upper and lower plates 132, 134 extending outwardly from the stiles 136, with ends 166 of the skirt folding inwardly along the sides of the opening 20 and being secured to the stiles defining the perimeter sides of the opening with fasteners 168, with tension in the skirt maintaining the position thereof around the frame. In this embodiment, the skirt 60, 160 may be secured only to the end stiles defining the opening 20. When installed, the skirt 60, 160 defines the interior space 18, 118, along with a bottom surface 70, 170 of the worksurface 14, 114.

Referring to FIGS. 7-15, the panel 24 may be removably secured to the frame 30, 130. In one embodiment, the panel 24 is pivotally mounted to the peripheral wall 16, 116, and the frame in particular, and may include a bottom portion pivotally mounted to the peripheral wall about a horizontal axis 72 with a hinge 74. The panel 24 includes an outer cover 76 having a frame 78 and a skin 80, made for example of the same material as the skirt 60, 160. In one embodiment, the frame 78 includes a base plate 82, a pair of mounting flanges 84 extending from opposite sides of the base plate 82 and a rim 86 extending from a periphery of the base plate in a direction opposite the mounting flanges. The rim 86 defines a recess in which the skin 80 is disposed and mounted. In other embodiments, the rim may be omitted, with the skin 80 being attached to the base plate with fasteners 88, such as screws, bolts or adhesive. The base plate 82 and skin 80 may have an opening 90 formed therein so as to define a handle, which may be gripped by the user to lift and pivot the panel about the axis 72. The opening 90 may be an elongated horizontal slot shaped and sized to receive a user's fingers.

Figure 12A:
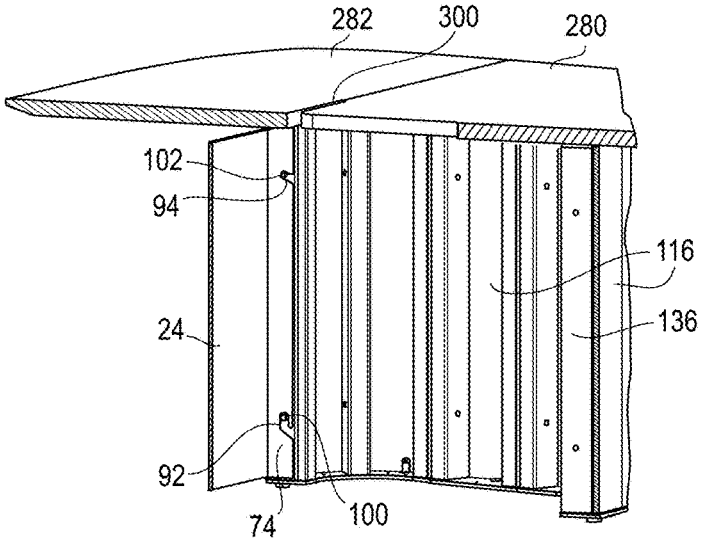
FIGS. 12A-C show a panel in a closed position, a panel in an open position and a close-up view of the panel hinge.
Figure 12B:
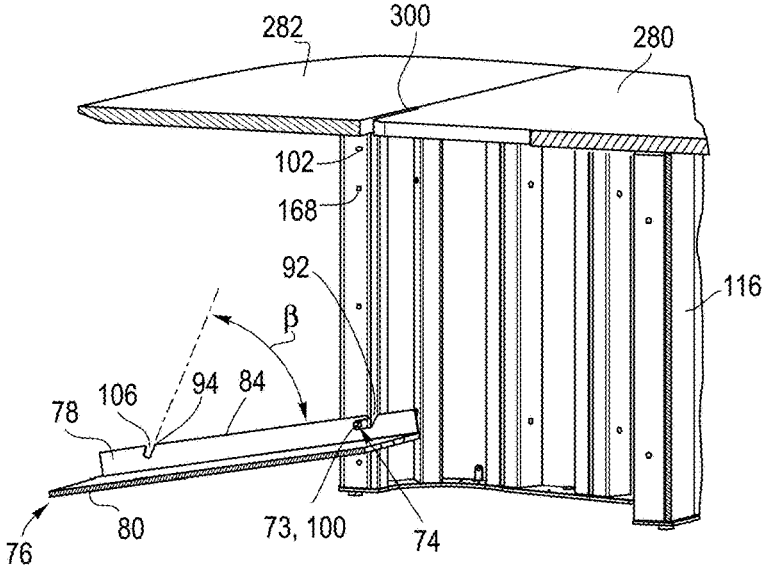
Figure 12C:
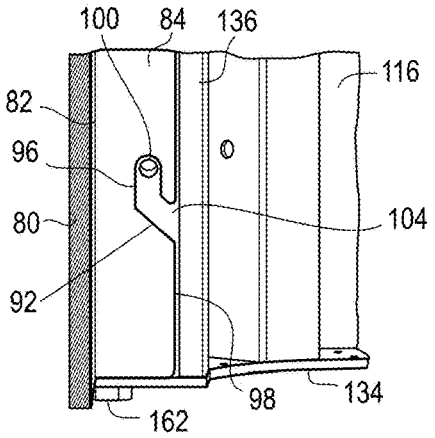

Each mounting flange 84 includes a pair of longitudinally spaced slots 92, 94. The slots are angled upwardly from a mouth at the edge of the flange toward a top of the flange, for example at an acute angle β. In one embodiment, the bottom slot 92 further includes an elongated portion 96 extending parallel to an edge 98 the flange. The elongated portion 96 extends vertically upwardly when the panel 24 is in the vertical, closed position as shown in FIG. 12C. The frame 30, 130 includes a pair of laterally extending pivot axles 100 extending inwardly into the opening 20 near the bottom of the base, and defining in part the hinge 74, and a pair of pins 102 extending inwardly into the opening 20 near the top of the base to define a latch. To install the panel, the panel 24 is moved such that the pivot axles 100 are inserted through a mouth 104 of the bottom slots 92 and into the elongated portion 96 of the slots. The panel 24 may them be pivoted about the axles 100, forming the hinge 74. The panel may be lifted slightly vertically to align a mouth 106 of the top slots 94 with the pins 102, with the axles moving in the bottom slots. Once the top slots 94 are aligned with the pins 102, the panel 24 may be moved vertically downwardly, with the angle (3) and orientation of the slots 92, 94 drawing the panel 24 inwardly to the closed position. In this way, the panel 24 is both removably coupled to the frame 30, 130, meaning the panel may be removed simply by disengaging the pivot axles 100 from the bottom slots through lifting, and is also pivotally connected to the frame, for example by pivoting about the pivot axis 72 and with the weight of the panel 24 maintaining the connection between the panel and frame by way of gravity. It should be understood that the panel 24 may be pivotally connected to the frame with other types of pivots and secured thereto in a closed position, for example with a latch, detent, hook, or other locking device.

The panel 24 further includes an electronics mounting plate 108 having a base plate 200 and a pair of mounting flanges 202 extending from opposite sides of the base plate. The mounting flanges 202 may overlap with the mounting flanges 84 of the cover. In one embodiment, the mounting flanges 84, 202 may be coupled, for example with fasteners, such that the base plates are spaced apart and provide air circulation therebetween. Alternatively, the mounting flanges 202 may each include upper and lower slots 204 206 having the same shape and being aligned with the slots, such that the mounting plate may be separately moved and removed relative to the base, as shown for example in FIGS. 8 and 9. The slots 204, 206 are formed in the corner of the base plate 200 and mounting flange 202. The base plate 200 is maintained spaced apart from the base plate 82 by way of the slot locations, such that air circulation between the plates is maintained.

The base plate 200 includes electronic component mounting features 210. The mounting features 210 may be configured as a plurality of openings 212, which may receive fasteners such as screws or bolts, extending through the electronic components 220, or clamps or other components engaging the electronic components. In one embodiment, the plurality of openings 212 define a grid or array 214 of openings, providing limitless numbers of mounting configurations. The base plate may include an opening 216, such as a slot, that is aligned with the openings 90 in the cover. The mounting plate 108 may be removably coupled to the cover 76, or removably coupled to the frame 30, 130, meaning different mounting plates, with different electronic component 220 combinations, may be quickly and easily exchanged. The electronic components 220 may include without limitation processors, power sources, data storage devices, modems, video transmission equipment, etc. For example, in one embodiment, the electronic components 220 may include DSP, Mixers & Network Interfaces, which are components that assist AV installers with managing multi-microphone installations in boardrooms, meeting rooms, classrooms, etc. The electronic components 220 may also include Mini Computers, which are components typically used for running the video conferencing software (ex. Microsoft Teams or Zoom) as well as providing audio and visual input/output. The electronic components 220 may also include Power Supplies & Adapters (Power Management), which may include many different power adapters/bricks required for any DSP, Mixer, Network Interface, Mini PC, microphones, room controller, laptop, phones, etc. devices used at the table. These power adapters work to covert AC (alternating current) power from a standard electrical outlet to DC (direct current) power utilized by the associated device. In some instances devices may require Power over Ethernet (PoE) allowing them to receive power through the Ethernet cable that connects them to the network. With the various sources of power that can be utilized dependent on the device it would not be uncommon for power adapters to be utilized as well.

Figure 13:
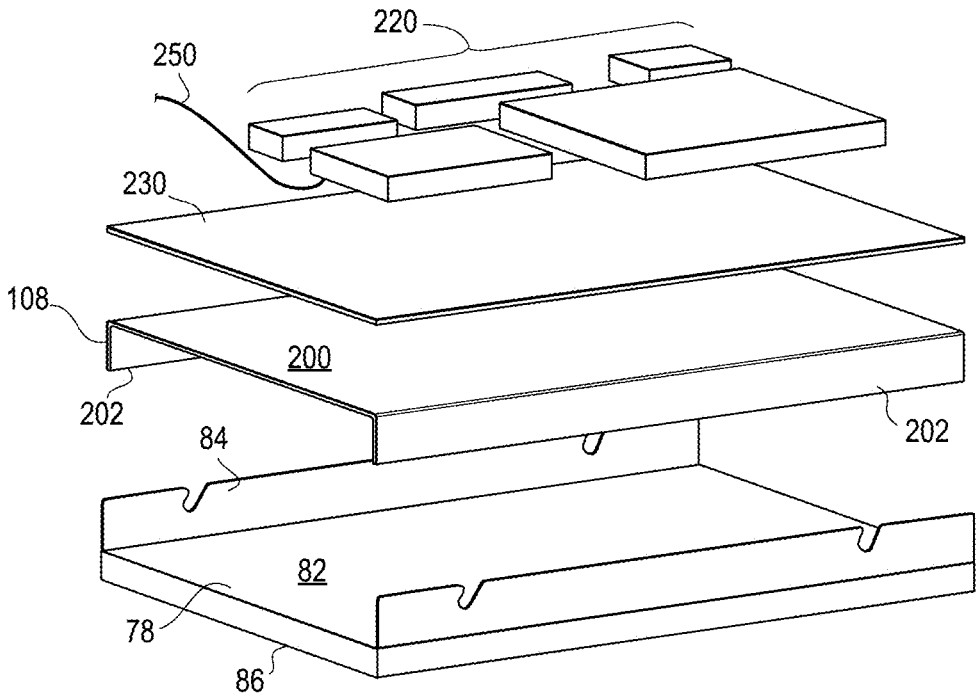
FIG. 13 is an exploded view of a panel.
Figure 14A:
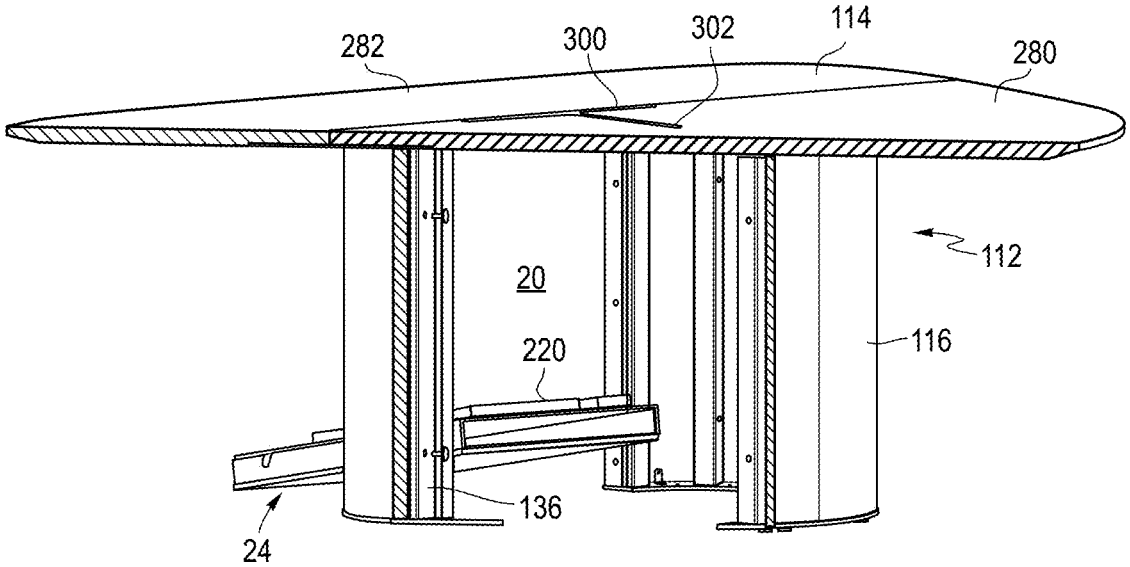
FIGS. 14A and B are cut-away views of a conference table with a panel in an open position and a closed position respectively.
Figure 14B:
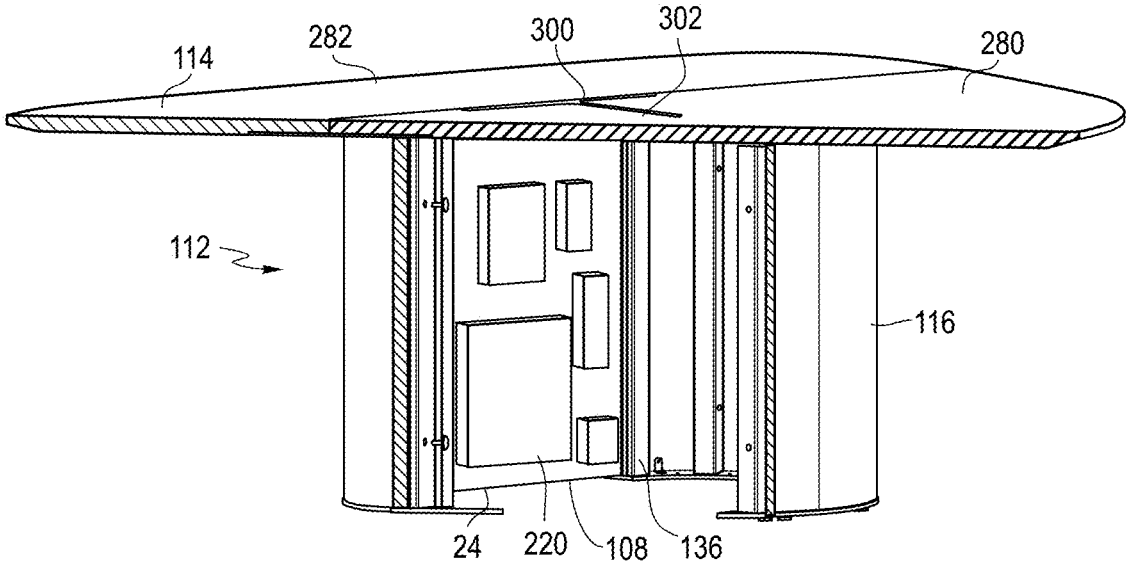
Figure 15:
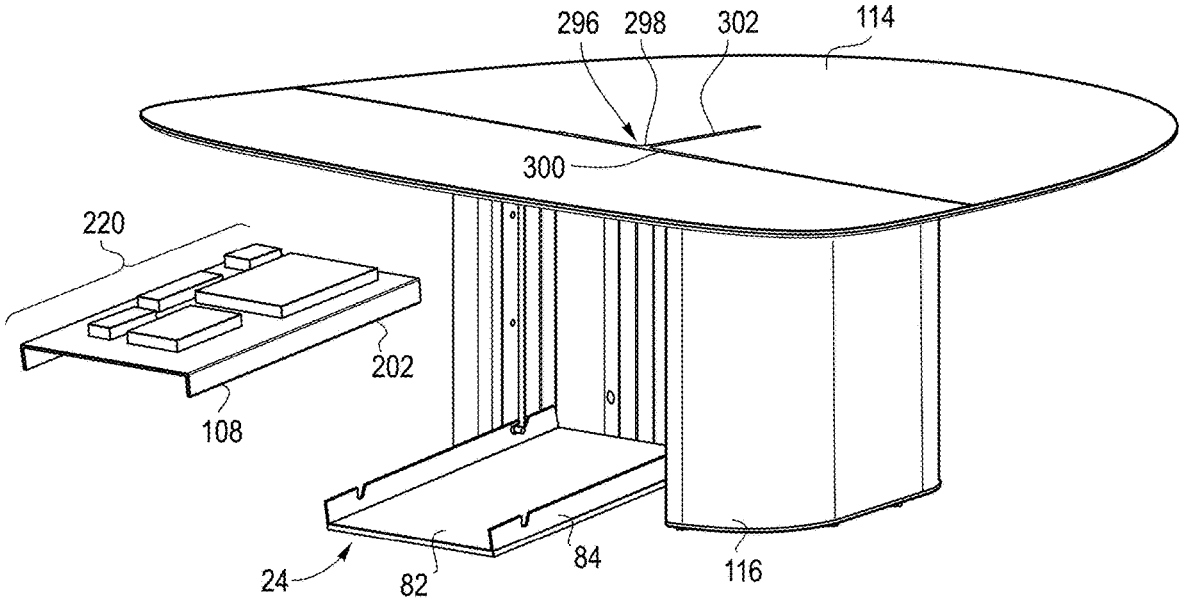
FIG. 15 are perspective views of a conference table with a panel in an open position and a partially exploded position.

In another embodiment, shown for example in FIG. 13, an additional, or auxiliary, mounting plate 230, or sheet, may include various electronic components 220 preassembled thereon. The auxiliary plate 230 may be coupled to the mounting plate 108 with fasteners. The auxiliary mounting plate 230 may be removed with the mounting plate, or separately removed. In one embodiment, an electronic component 220 is coupled to the mounting features 210, and a utility cable 250 is coupled to the electronic component and extends through an aperture 260 in the worksurface 14, 114.

Figure 4:
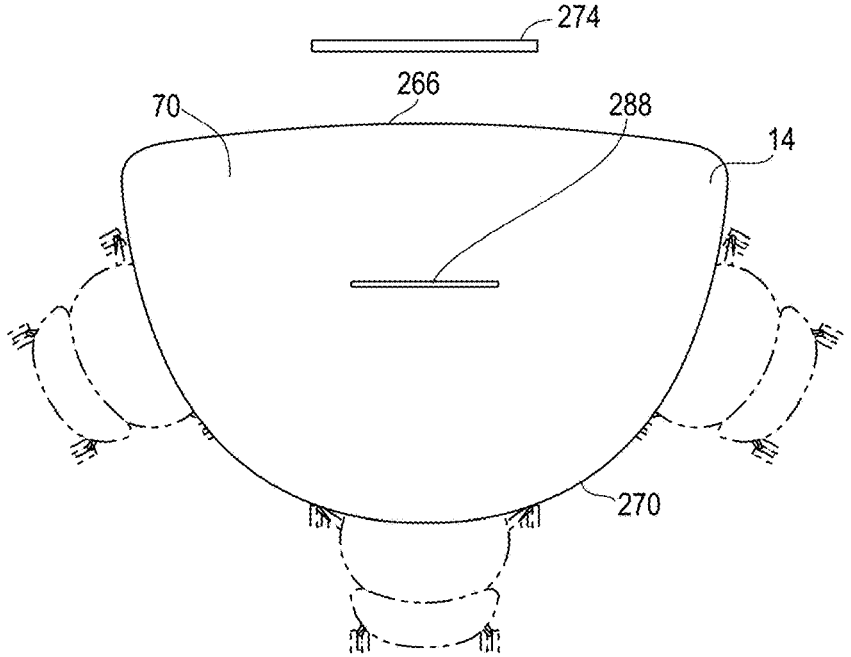
FIG. 4 is a top view of the conference table shown in FIG. 1.

Worksurface:

Referring to FIGS. 1-6 and 16, in one embodiment, a worksurface 14, 114 has an upper surface 262, 264 configured to receive various personal and office related items, such as computers, documents, telephones, storage items and the like, while providing a suitable surface for writing. The worksurface 14, 114 is supported by the base 12, 112, which is secured to a bottom surface 70, 170 of the worksurface. The worksurface 14, 114 may have a variety of different shapes in plan view, including a generally gumdrop shape with a relatively straight rear edge 266, 268 and a curved edge front edge 270, 272. The rear and front edges 266, 268, 270, 272 may have linear edge portions and curve edge portions, for example at the junctions between the front and rear edges. The curved front edge 270, 272 is shaped and sized to allow a plurality of users to sit adjacent the front edge and face and/or observe a camera and/or display 274 positioned adjacent to or spaced from the rear edge 266, 268. For example, as shown in the embodiment of FIG. 4, three users are positioned around the front edge 270, while in the embodiment of FIG. 5, five users are positioned around the front edge 272. The flattened rear edge 266, 268 provides indicia to the users that chairs should not be positioned therealong for video conferencing. The conference table may be sized to accommodate more than five users. The peripheral edges 270, 272 of the worksurface 14, 114 extend outwardly from the side surface of the base 12, 112, for example a distance sized to comfortably fit the user's legs under the worksurface. The monolithic structure of the pedestal base, and uninterrupted overhang of the worksurface, avoids the need for table legs that may block various user positions from being useable. This configuration allows the users of the table to sit at any location around the worksurface that suits their use.

Figure 5:
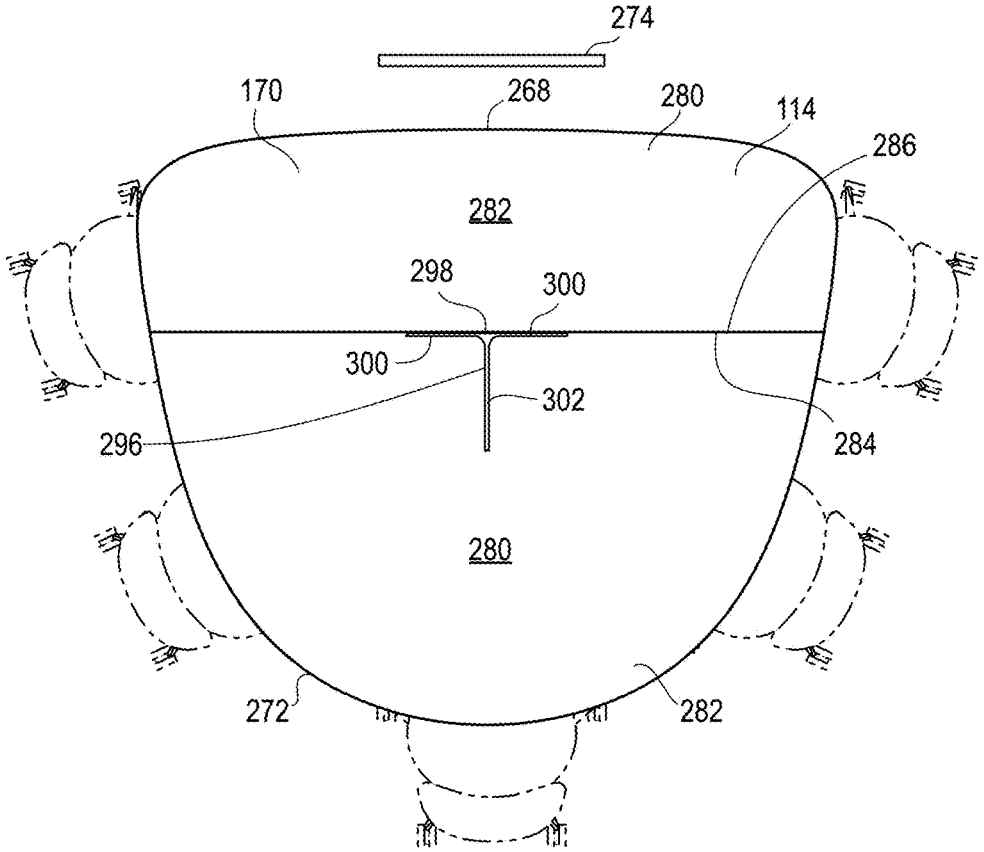
FIG. 5 is a top view of the conference table shown in FIG. 2.
Figure 6:
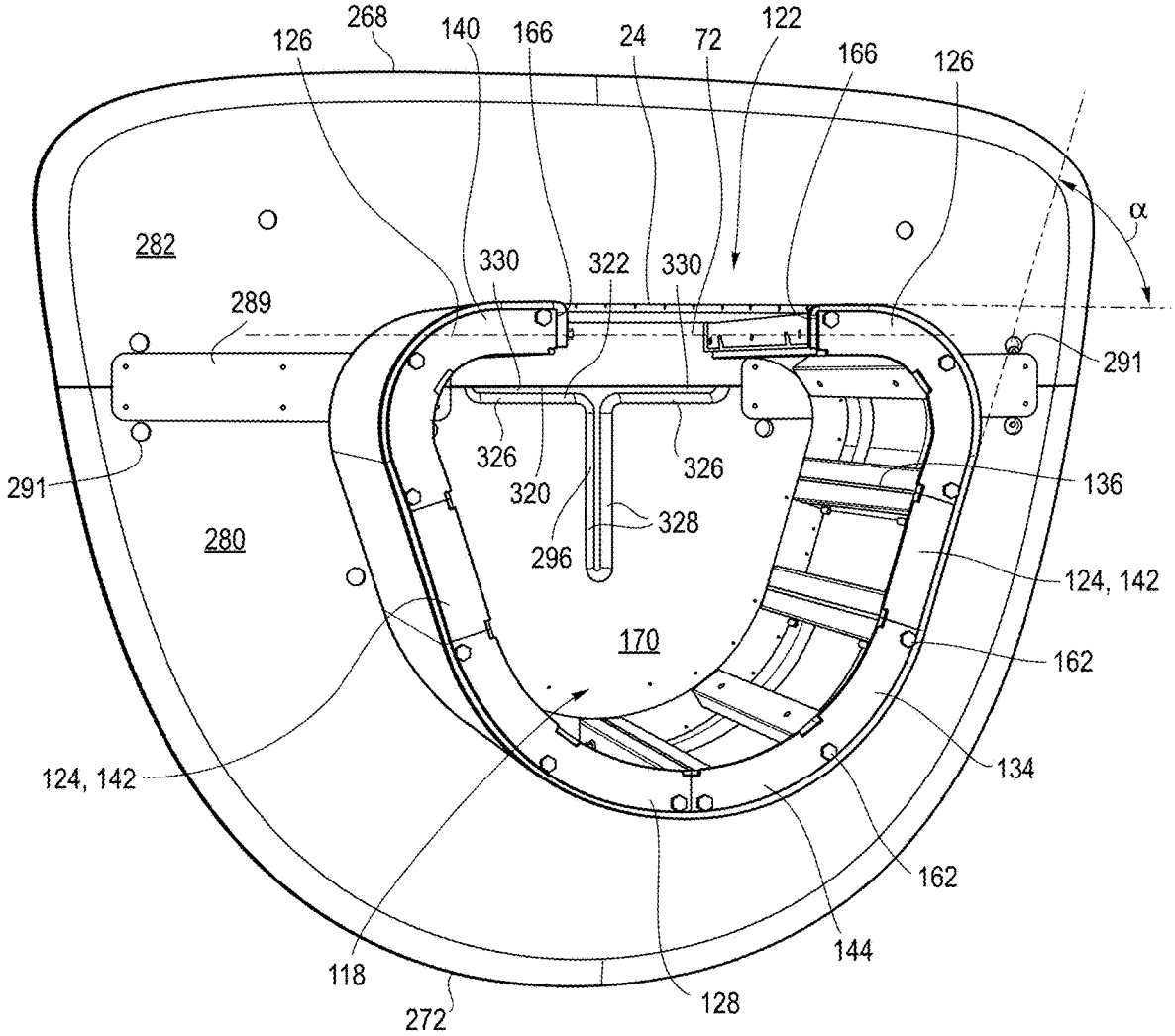
FIG. 6 is a bottom perspective view of the conference table shown in FIG. 2.
Figure 7:
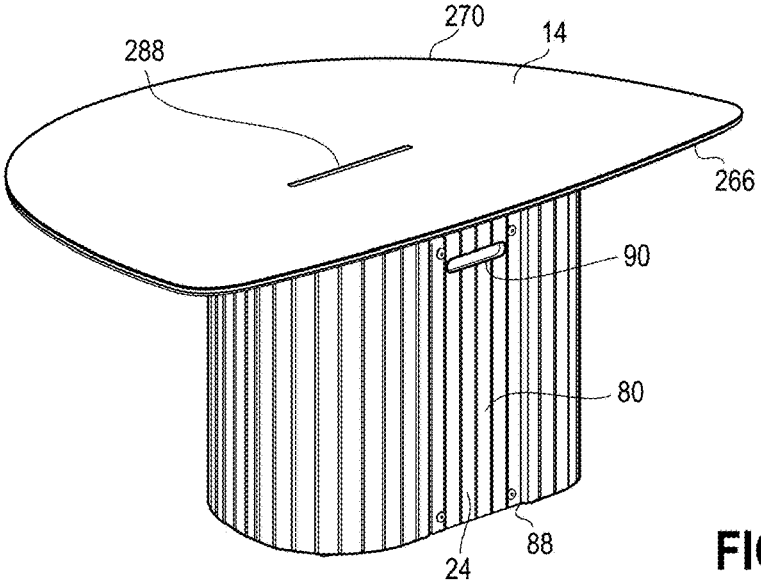
FIG. 7 is a perspective view of the conference table show in FIG. 1.
Figure 8:
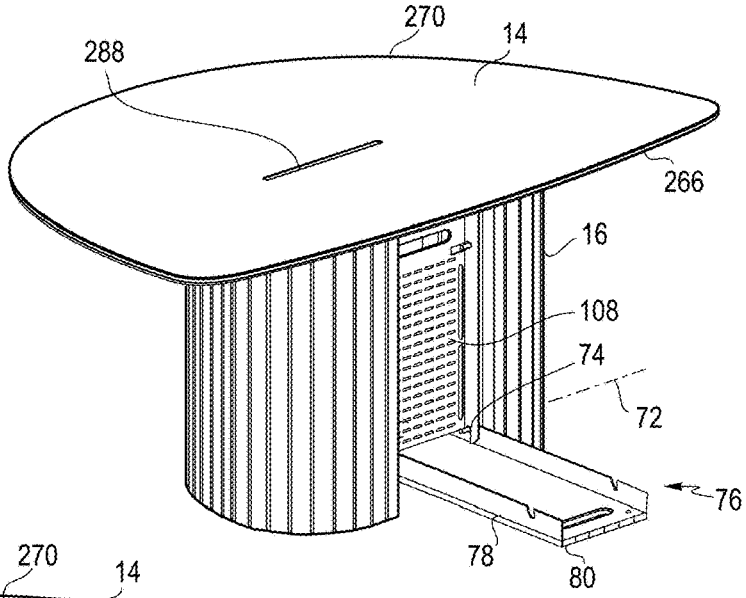
FIG. 8 is a perspective view of the conference table show in FIG. 1 with an outer cover portion of a panel in an open position, and a tray in an closed position.
Figure 9:
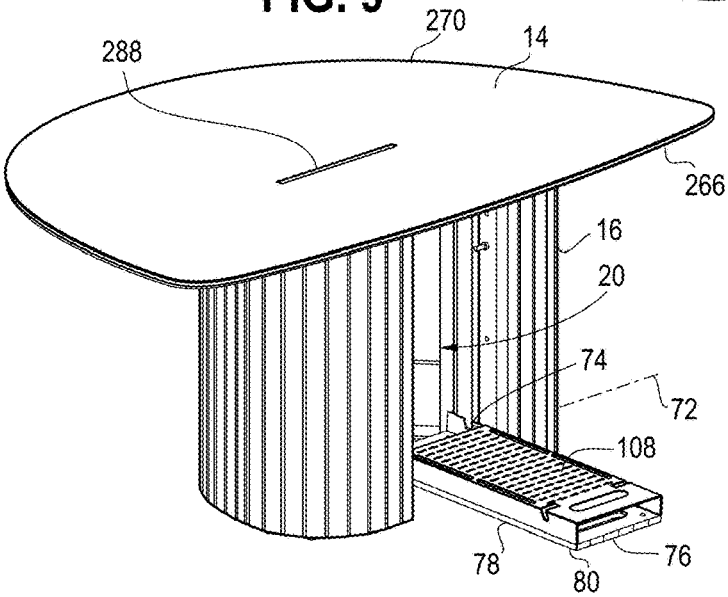
FIG. 9 is a perspective view of the conference table show in FIG. 1 with a panel in an open position.
Figure 10:
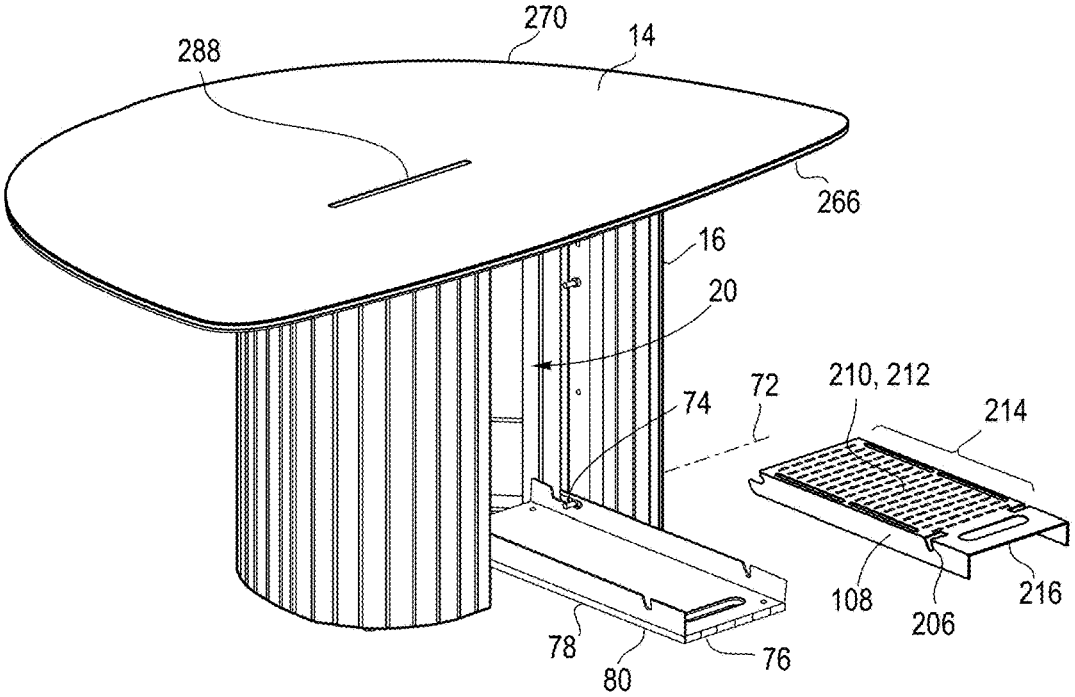
FIG. 10 is a perspective view of the conference table show in FIG. 1 with an outer cover portion of a panel in an open position, and a tray in an exploded position.
Figure 11:
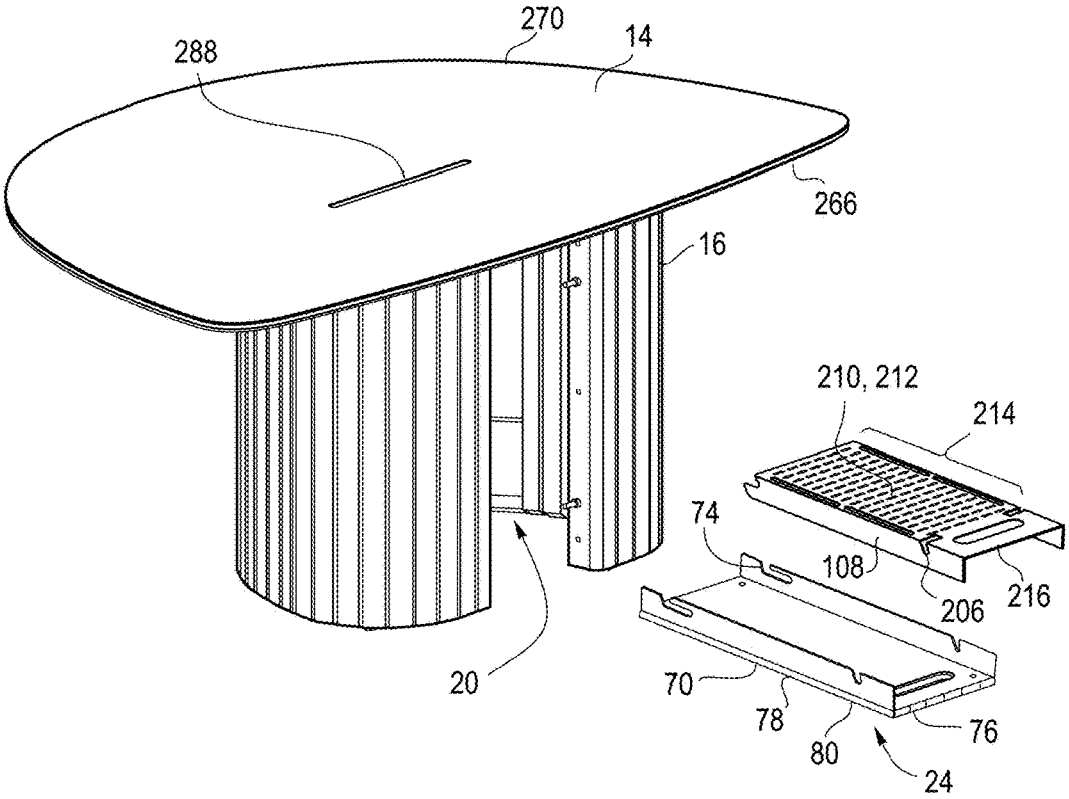
FIG. 11 is a perspective view of the conference table show in FIG. 1 with an outer cover and tray in an exploded position.

As shown for example, in FIGS. 5 and 6, the worksurface 14, 114 may be include first and second worksurface piece 280, 282 abutting along mating edges 284, 286. The worksurfaces may be joined with mounting plates 289 underlying and coupled to the bottom surfaces 70, 170 of each worksurface. In addition, a plurality of clamping devices 291, for example zip bolts, may be mounted to the worksurface pieces 280, 282 and clamp together the abutting edges 284 286 of the worksurface pieces. The worksurface pieces 280, 282 may have different finishes, including being made of different materials and/or with different exterior colors and/or tactile surfaces. The worksurface 14, 114 may be made for example and without limitation from particle board with HPL, LOP or veneer exterior, plywood, plywood with Forbo linoleum, or combinations thereof, and may include metal, wood or stone, such as granite.

Figure 16:
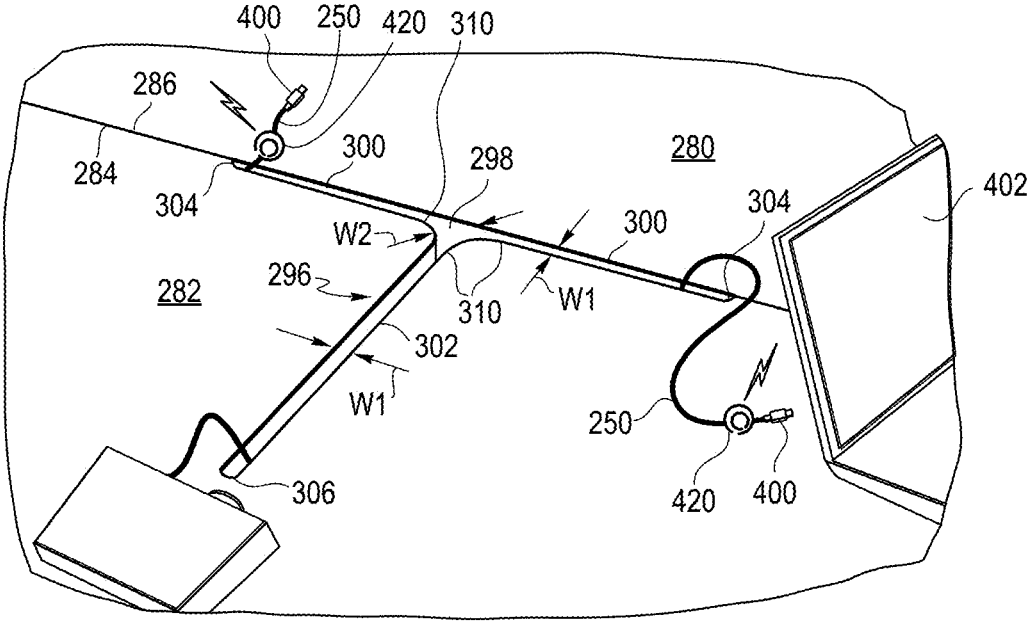
FIG. 16 is a partial perspective view of a worksurface with an aperture and cable retention devices disposed thereon.
Figure 17:
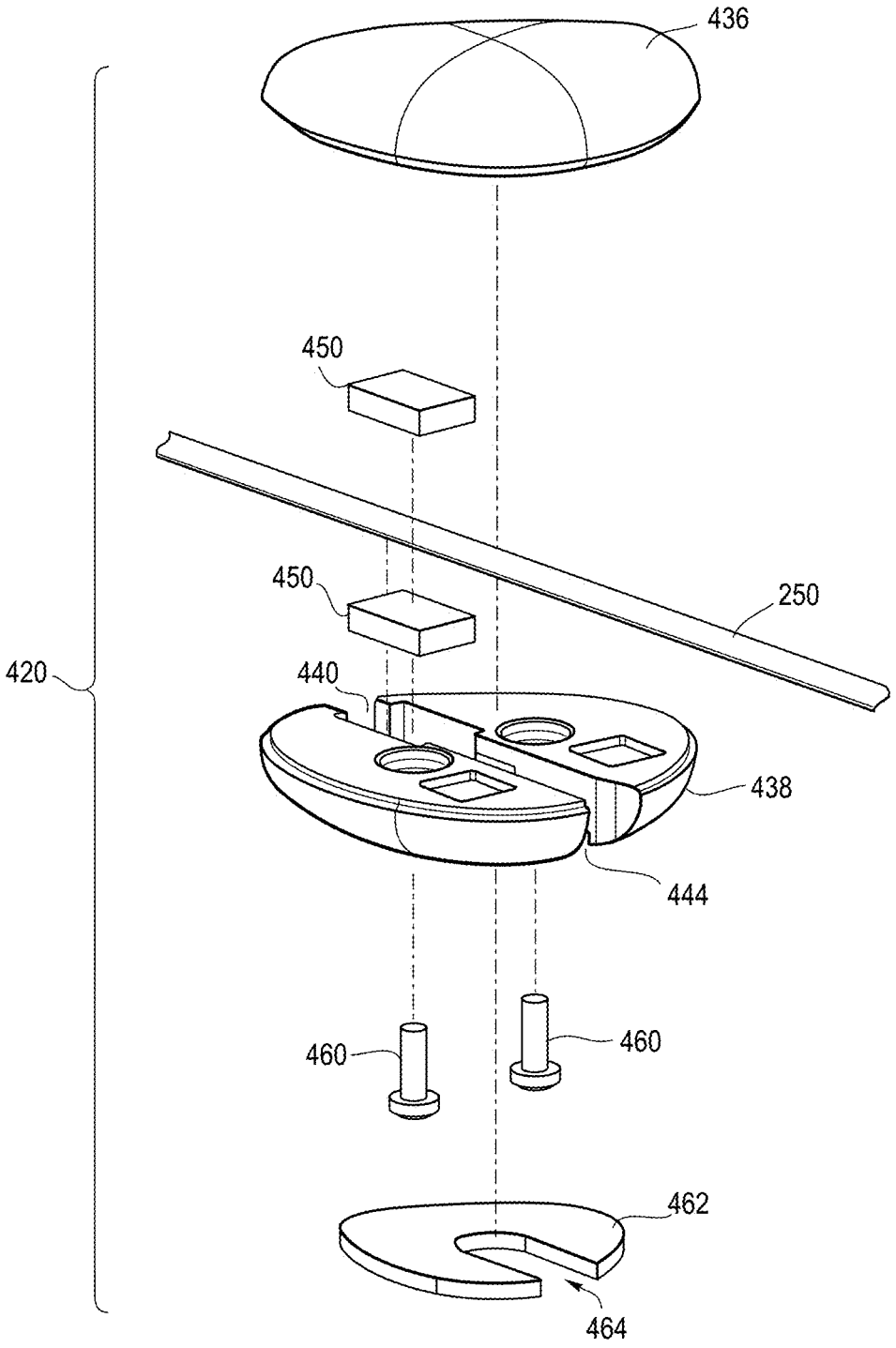
FIG. 17 is a top perspective view of one embodiment of a cable retention device.
Figure 18:
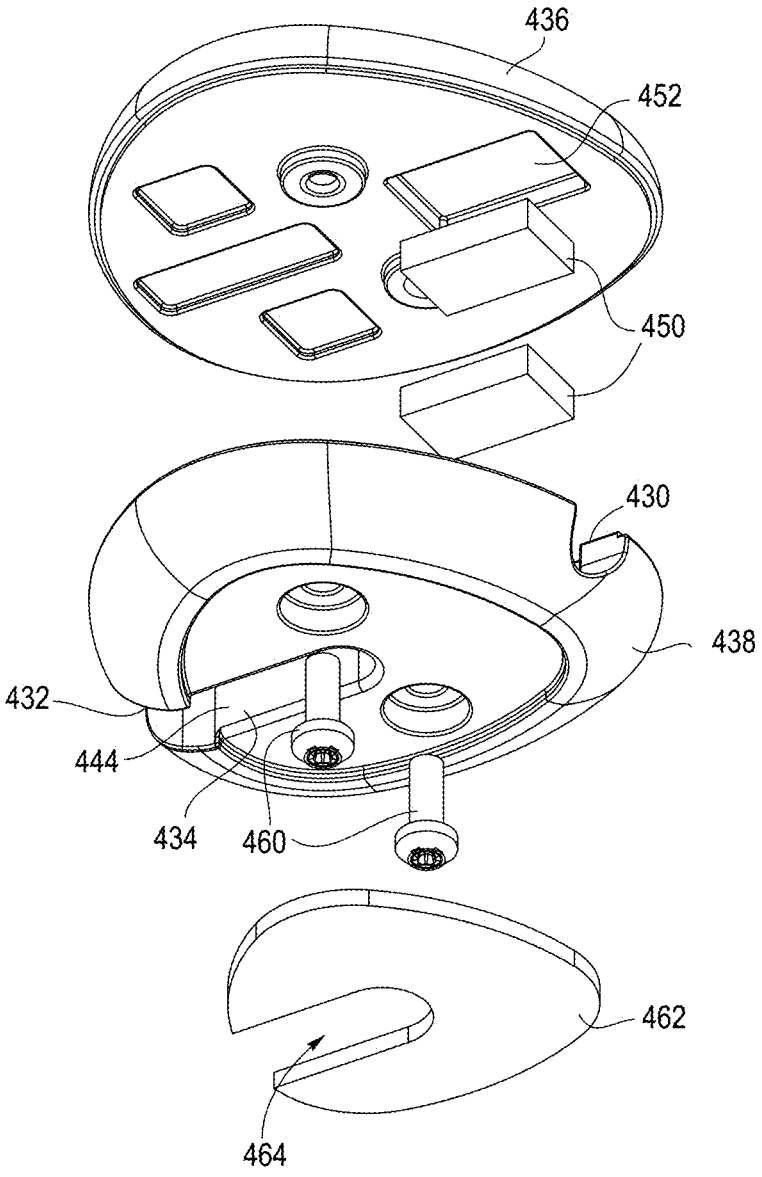
FIG. 18 is a bottom perspective view of the cable retention device shown in FIG. 17.
Figure 19:
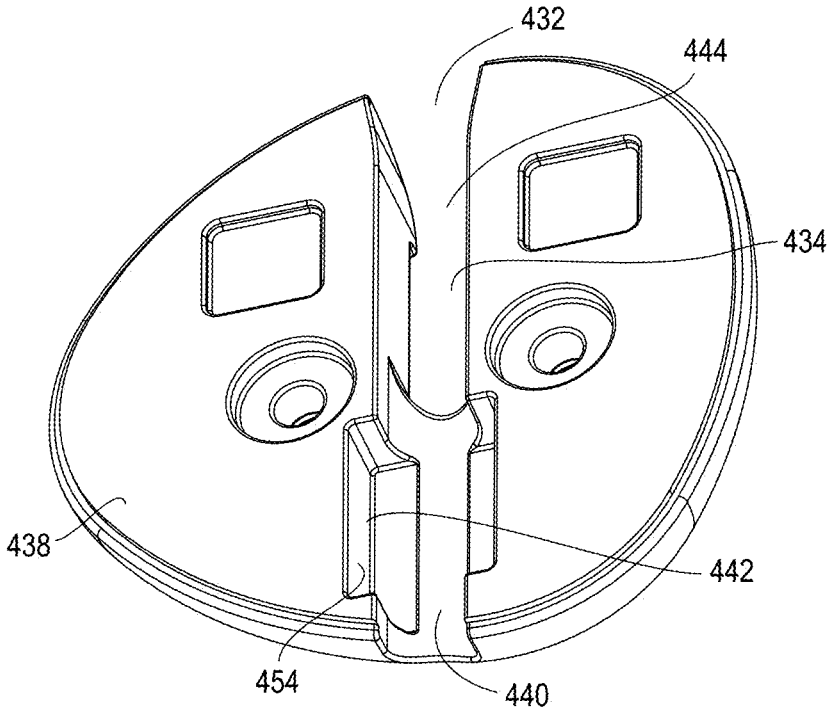
FIG. 19 is a top perspective view of a first clamping component.
Figure 20:
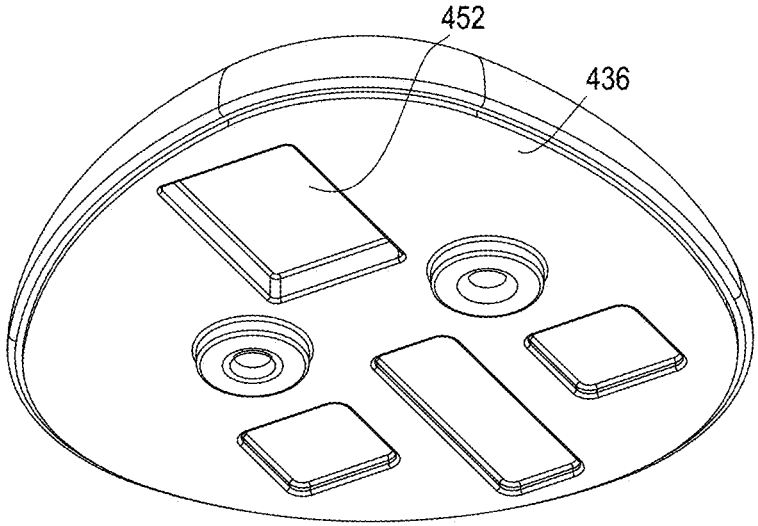
FIG. 20 is a bottom perspective view of a second clamping component.
Figure 21:
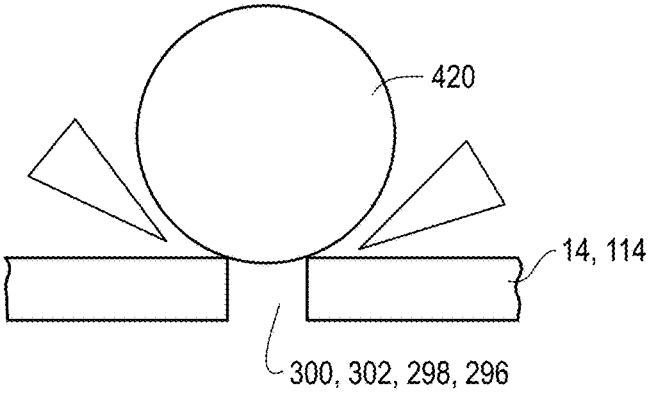
FIG. 21 is a schematic side view of a cable retention device positioned over an aperture.
Figure 22:
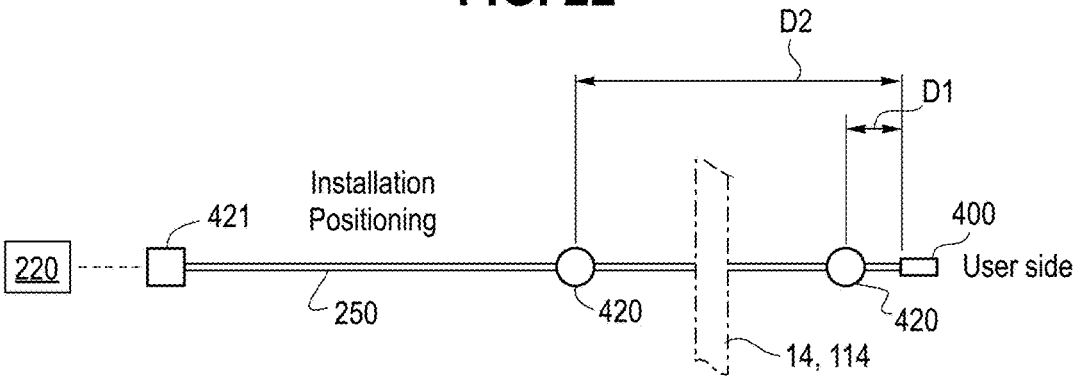
FIG. 22 is a view of one embodiment of a cable with a pair of cable retention devices secured thereto.

As shown in FIG. 4, the worksurface 14, 114 is configured with an elongated aperture 294, configured in one embodiment as a linear slot 288, having terminal ends 290 that are spaced $L_m$ from the front peripheral edge 270, 272 at a maximum of 36 inches from the peripheral edge, and in one embodiment a maximum of 32 inches from the peripheral edge, and in one embodiment at a distance of about 30 inches from the peripheral edge. In one embodiment, the terminal ends 290 are spaced a distance ($L_m$) of at least 6 inches from the peripheral edge. As shown in the embodiment of FIGS. 5 and 16, the aperture 296 includes a node 298 and at least three branches 300, 302 extending radially outwardly from the node. In other embodiments, the aperture may include two branches extending non-parallel from the node. The terminal edges 304, 306 of the branches are located within $L_M$ of the front peripheral edge 270, 272, or positioned a maximum of 36 inches from the peripheral edge, and in one embodiment a maximum of 33 inches from the peripheral edge, and in one embodiment at a distance of about 32 inches from the front peripheral edge of the worksurface pieces. In one embodiment, the terminal ends 304, 306 are spaced a distance ($L_m$) of at least 6 inches from the peripheral edge. In one embodiment, each of the branches 300, 302 has a greatest width (W1), while the node 298 has a width (W2) greater than the greatest width (W1) of each of the branches. The greatest width (W1) of each of the branches 300, 302 is less than 0.53 inches, while the node 298 has a width (W2) of greater than 1.0 inches in one embodiment, and about 1.50 inches in one embodiment. Each of the branches 300, 302 has a proximal end 310 opening into and communicating with the node 298, meaning a cable may be passed (e.g., slid) from one branch 300, 302 through the node 298 and into another branch 300, 302. The node 298 is sized and configured to permit a standard U.S. power plug (e.g., Type A and Type B) to pass through the node in one embodiment, or a standard power plug for a designated jurisdiction, but do not permit a user's hand or cable retention device 420 described below to pass through.

As shown in FIG. 5, two of the branches 300 may be defined by adjacent, spaced apart edges 320, 322 of the worksurface pieces. In one embodiment, three branches 300, 302 are arranged in a T-shape. Each of the branches 300, 302 has pair of upper edge corners on an upper surface of the worksurface(s) and a pair of lower edge corners 326, 328, 330 on a lower surface of the worksurface(s). As shown in FIG. 6, at least portions of at least some of the lower edge corners 326 are chamfered. For example, all of the lower edges 326, 328 defined by the worksurface piece 282 may be chamfered, while the lower edge corners 330 defined by the worksurface piece 280 are not chamfered. The worksurface piece 282 defines a first portion of the front peripheral edge and at least a portion of one of the upper edges of one of the branches and the second worksurface piece 280 defines a second portion of the front peripheral edge and at least a portion of the other of the upper edges of the one of the branches.

Figure 23:
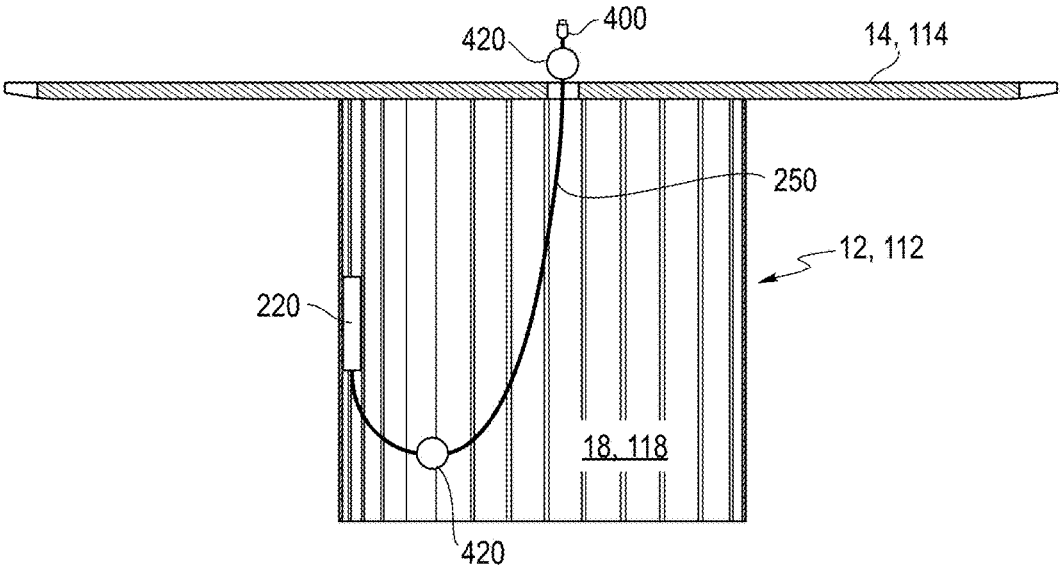
FIG. 23 is a view of a cable retained on a conference table by a pair of cable retention devices.

As shown in FIGS. 16 and 23, the utility cable 250 extends through the aperture. The utility cable may be configured as a USB, USB-C, USB-B, USB-Mini, USB-Micro, or HDMI cable, or a power cord connected to a power source mounted in the interior space 18, 118 of the base, for example on the panel mounting plate 108, 230. The utility cable 250 includes a connector portion 400 disposed above the worksurface. The connector portion 400 is configured to be plugged into, and electrically connected to, an electronic mobile device 402, such that power and data may be transmitted to the device 402. Users sitting adjacent the front peripheral edge may access the connector portion 400 and plug the connector portion into their electronic mobile devices 402 to power and exchange data between the electronic mobile device and electronic components 220 mounted below the worksurface in the interior space 18, 118. The electronic mobile device 402 may be a computer, including a laptop computer, a tablet, mobile phone, including smart phones, and/or any electronic device carried by a user and capable of being powered and/or transmitting data.

Cable Retention Device:

Referring to FIGS. 16 and 21-24B, the connector portion 400 may be susceptible to passing through the aperture 294, 296, whether through one of the branches 300, 302 or the node 298. A cable retention device 420 may be secured to the cable 250 above the worksurface 14, 114 to prevent the connector portion 400 from passing through the aperture 294, 296. In addition, a cable retention device 420 may be secured to the cable 250 below the worksurface 14, 114 to prevent the cable 250 from being disconnected from an electronic component 220 disposed in the interior space 18, 118, and also with the weight of the cable retention device 420 acting as a cable retraction device and pulling the cable downwardly through the aperture by the force of gravity. In one embodiment, shown in FIG. 22, a first cable retention 420 device may be coupled to the cable 250 at a distance D1 from the connector portion 400. In various embodiments, D1 may be between 2 and 6 inches, and preferably about 3 inches. A second cable retention device 420 may be coupled to the cable 250 at a distance D2 from the connector portion 400. In various embodiments, D2 may be between 15 and 35 inches, and preferably about 26 inches. The connector portion 400 is allowed a travel distance of D2–D1, thereby allowing a user to pull the cable 250 through the aperture 294, 296 such that the connector portion 400 is located at a desired location above the worksurface. The chamfered, or rounded, edge 326, 328 on the bottom of the aperture reduces wear on and snagging of the cable.

The cable retention device 420, otherwise referred to as a pod, includes a housing 422 having a bottom 424, a peripheral side 426, a top 428, an inlet 430 formed in the peripheral side, a first outlet 432 in communication with the inlet and formed in the peripheral side at a location spaced apart from the inlet, and a second outlet 434 in communication with the inlet and formed in the bottom. The housing 422 may be configured with first and second clamping components 436, 438, one or both which may define in part the inlet 430. The first clamping component 436 defines the top 428 of the housing and the second clamping component 438 defines the bottom 424 of the housing. In one embodiment, the second clamping component has a channel 440 with a bottom surface 442 and an opening communicating with the channel. The opening 444 is open to the bottom 424 of the housing and also to the side 426, and defines the first and second outlets. The channel 440 defines the inlet 430 in the side 426 opposite the outlet 432. First and second resilient components 450 are disposed between the first and second clamping components 436, 438, for example in recesses 452, 454 formed in each of the clamping components. The resilient components 450 are compressible, and may be made of foam. The cable 250 is disposed in the channel 440 between the first and second resilient components 450. The clamping components are then coupled, for example with fasteners 460, thereby compressing the resilient components 450 against the cable 150 to hold the cable and prevent the cable from being pulled through the cable retention device. The channel 440 is preferably sized to handle the largest standard cable that may be used, with the resilient components 450 gripping and retaining smaller cables. For example, HDMI cables typically have a significantly larger diameter than a standard USB-c cable, but with both cables being retained by the cable retention device.

The fasteners 460 may include screws, bolts, snap-fit tabs, pivot locks, or other suitable connectors. A foot 462 may be disposed on the bottom of the housing, and cover the fasteners 460, for example on a bottom of the clamping component. The foot 462 may be made of polyurethane polymer, and provides a sufficient coefficient of friction to prevent unattended sliding of the cable retention device for example due to the weight of the cable and connector, but allowing the user to manipulate the cable retention device by sliding the device along the surface of the worksurface. The foot 462 includes a slot 464 aligned with the outlet 434.

Figure 24A:
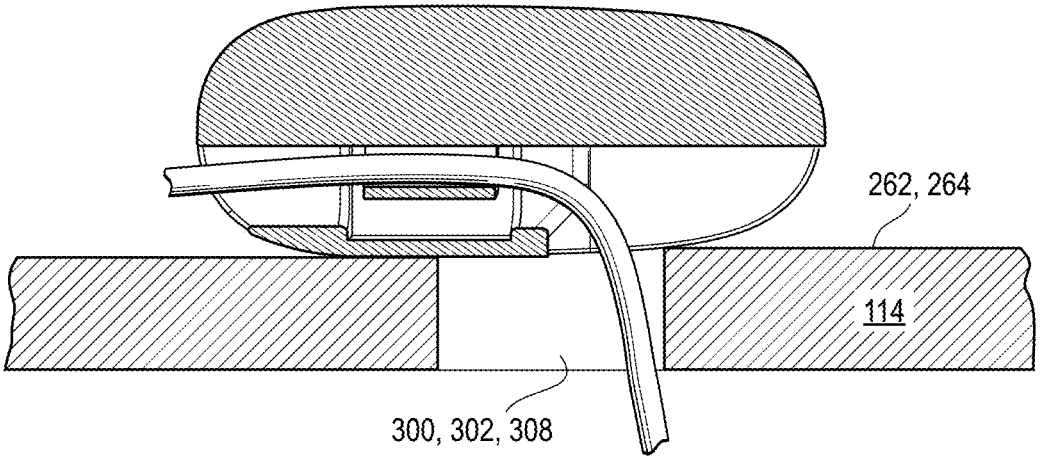
FIGS. 24A and B are cross-sectional views of a cable retention device coupled to a cable and overlying an aperture and spaced apart from the aperture.
Figure 24B:
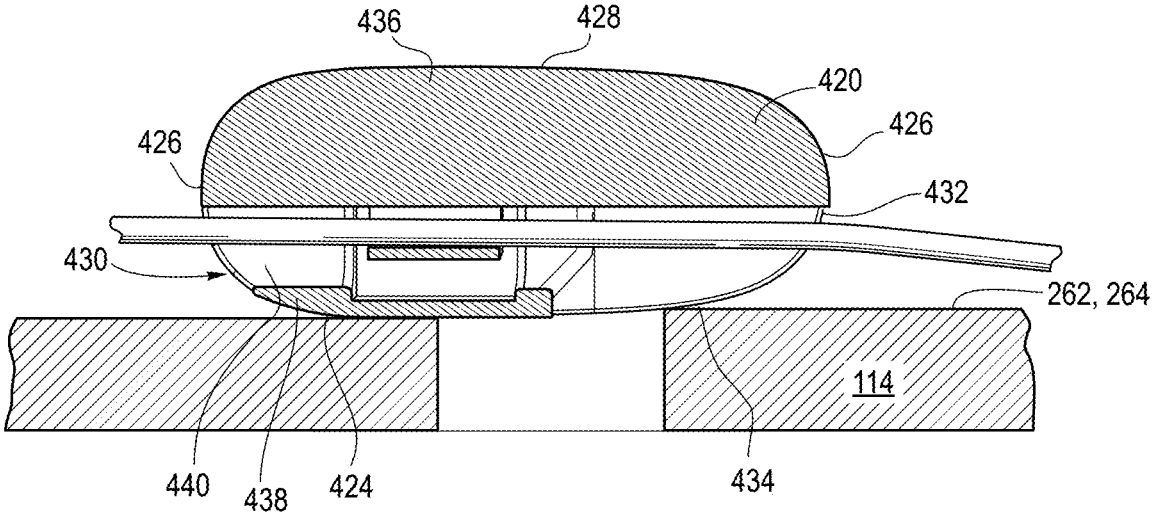

The cable retention device 420, or pod, is moveably supported on the upper surface 262, 264 of the worksurface, and is shaped and dimensioned to prevent the pod from passing through the branches 300, 302 or the node 298. For example, the pod has a greater width and/or length than the width of the branches and/or node. The inlet 430 and the first outlet 432 are parallel to the upper surface, while the second outlet 434 opens downwardly toward the upper surface 262, 264. The utility cable 250 passes through the inlet 430 and first outlet 432 when the pod is not overlying one of the branches 300, 302 or the node 298, as shown in FIG. 24A, but the cable 250 passes through the inlet 430 and the second outlet 434 when the pod and the second outlet 434 are overlying one of the branches 300, 302 or the node 298 as shown in FIG. 24B. A second cable retention device 420 is fixedly connected to the utility cable and disposed below the worksurface, wherein the second pod is shaped and dimensioned to prevent the second pod from passing upwardly through the branches 300, 302 or the node 298. In this way, the second pod prevents the utility cable from being dislodged from a connection to an electronic component 220, such as a power source, in the interior space 18, 118.

Operation:

In operation, and referring to FIGS. 16 and 22-24B, an installer passes a utility cable 250 through the aperture 294, 296 with the connector portion 400 disposed above the worksurface and a plug 421 disposed below the worksurface 14, 114. A cable retention device 420 is secured to the utility cable 250 above the worksurface. A second cable retention device 420 may be secured to the utility cable 250 below the worksurface if desired. The plug 421 may be coupled to an electronic component 220. A user may access the connector portion 400 and connect the connector portion to an electronic mobile device 402, thereby providing power and/or data to the electronic device 402. When done, the user may disconnect the connector 400 from the electronic device 402, with the cable retention device 420 maintaining the position of the connector 400 on top of the worksurface. The user may move the connector position 400, and cable retention device 420, on the worksurface, with the cable 250 passing through the outlet 432 if not overlying the aperture, or through the outlet 434 if overlying the aperture. The cable may slide along the chamfered surface depending on the location of the electronic component 220 in the interior space 18, 118.

In this way, a method of using the conference table includes maintaining a connector portion 400 of the utility cable 240 on the upper surface of the worksurface with the cable retention device 420 fixedly connected to the utility cable 250, wherein the utility cable extends through an aperture 294, 296 in the worksurface and wherein the cable retention device has a larger or different footprint than the aperture such that the cable retention device is prevented from passing through the aperture. The user may move the cable retention device relative to the upper surface to position the connector portion 400 and thereby move the utility cable 250 relative to the aperture 296, 294. The user may position the electronic mobile device 402 on the worksurface and connect and disconnect the electronic mobile device to the utility cable 250, without fear that the cable will fall through the aperture. In addition, the utility cable is prevented from being pulled through the aperture by engaging a bottom surface of the worksurface with a second cable retention device 420 fixedly engaged with the utility cable 250 below the worksurface 14, 114.

If the user needs to access the interior space 18, 118, for example to secure a cable retention device 420 to a cable 250, or to replace one or more electronic devices 220, such as a power source, in the interior space, the user may move the panel 24 relative to the opening 20 from a closed position, wherein the panel is disposed over the opening, to an open position, wherein the interior space is accessible through the opening. The user may remove the inner mounting plate 108, 230, whether attached to the outer cover, or separately mounted to the frame. A second mounting plate may then be attached to the cover, or mounted to the frame. The panel 24 may thereafter be moved to the closed position. The user may also simply replace electronic components on the mounting plate in the open position without removing the panel or mounting plate from the base. The generally horizontal positioning of the mounting plate 108, 230 outside the interior space provides easy access to the electronic components 220.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A conference table comprising:

a base; and a worksurface supported by the base and comprising a peripheral edge, wherein the worksurface comprises an aperture comprising a node and at least three branches extending radially outwardly from the node, wherein each of the branches comprises a greatest width, and wherein the node comprises a width greater than the greatest width of each of the branches, and wherein each of the branches has a proximal end opening into and communicating with the node and a terminal end spaced from the node, wherein each of the terminal ends is spaced apart from and located within 36 inches of the peripheral edge of the worksurface.

2. The conference table of claim 1 wherein each of the branches has a pair of upper edges on an upper surface of the worksurface and a pair of lower edges on a lower surface of the worksurface.

3. The conference table of claim 2 wherein at least portions of at least some of the lower edges are chamfered.

4. The conference table of claim 1 wherein the greatest width of each of the branches is less than 0.53 inches.

5. The conference table of claim 1 wherein the width of the node is greater than 1.0 inches.

6. The conference table of claim 1 further comprising a utility cable extending through the aperture.

7. The conference table of claim 6 wherein the utility cable comprises a USB-C cable connected to a power source mounted on the base.

8. The conference table of claim 6 further comprising a pod fixedly connected to the utility cable, wherein the pod is moveably supported on an upper surface of the worksurface, and wherein the pod is shaped and dimensioned to prevent the pod from passing through the branches or the node.

9. The conference table of claim 8 wherein the pod comprises a first pod, and further comprising a second pod fixedly connected to the utility cable and disposed below the worksurface, wherein the second pod is shaped and dimensioned to prevent the pod from passing through the branches or the node.

10. The conference table of claim 1 wherein the branches and node are arranged in a T-shape.

11. The conference table of claim 1 wherein the base comprises a peripheral wall defining an interior space, an opening and a panel moveable between an open position wherein the interior space is accessible through the opening and a closed position wherein the panel is disposed over the opening.

12. The conference table of claim 11 wherein the panel is pivotally mounted to the peripheral wall.

13. The conference table of claim 12 wherein the panel comprises a bottom portion pivotally mounted to the peripheral wall about a horizontal axis.

14. The conference table of claim 1, wherein each of the terminal ends is at least 6 inches from the peripheral edge.

15. A conference table comprising:

a base; and a worksurface supported by the base and comprising a peripheral edge, wherein the worksurface comprises an aperture comprising a node and at least three branches extending radially outwardly from the node, wherein each of the branches comprises a greatest width, and wherein the node comprises a width greater than the greatest width of each of the branches, and wherein each of the branches has a proximal end opening into and communicating with the node and a terminal end spaced from the node, wherein each of the terminal ends is located within 36 inches of the peripheral edge of the worksurface; wherein the worksurface comprises a first worksurface piece defining a first portion of the peripheral edge and at least a portion of one of the upper edges of one of the branches and a second worksurface piece defining a second portion of the peripheral edge and at least a portion of the other of the upper edges of the one of the branches.

16. The conference table of claim 15 wherein the first and second worksurface pieces have different finishes.

17. A conference table comprising:

a base;

a worksurface supported by the base and comprising a peripheral edge, wherein the worksurface comprises an aperture comprising a node and at least three branches extending radially outwardly from the node, wherein each of the branches comprises a greatest width, and wherein the node comprises a width greater than the greatest width of each of the branches, and wherein each of the branches has a proximal end opening into and communicating with the node and a terminal end spaced from the node, wherein each of the terminal ends is located within 36 inches of the peripheral edge of the worksurface;

a utility cable extending through the aperture; and a pod fixedly connected to the utility cable, wherein the pod is moveably supported on an upper surface of the worksurface, and wherein the pod is shaped and dimensioned to prevent the pod from passing through the branches or the node, wherein the pod comprises an inlet opening parallel to the upper surface, a first outlet opening parallel to the upper surface, and a second outlet opening downwardly toward the upper surface, wherein the utility cable passes through the inlet and first outlet when the pod is not overlying one of the branches or the node, and wherein the cable passes through the inlet and the second outlet when the pod and the second outlet are overlying one of the branches or the node.

18. A conference table comprising:

a base, wherein the base comprises a peripheral wall defining an interior space, an opening and a panel moveable between an open position wherein the interior space is accessible through the opening and a closed position wherein the panel is disposed over the opening, wherein the panel comprises an outer cover and an inner mounting plate removably coupled to the outer cover, wherein the mounting plate comprises electronic component mounting features; and a worksurface supported by the base and comprising a peripheral edge, wherein the worksurface comprises an aperture comprising a node and at least three branches extending radially outwardly from the node, wherein each of the branches comprises a greatest width, and wherein the node comprises a width greater than the greatest width of each of the branches, and wherein each of the branches has a proximal end opening into and communicating with the node and a terminal end spaced from the node, wherein each of the terminal ends is located within 36 inches of the peripheral edge of the worksurface.

19. The conference table of claim 18 further comprising an electronic component coupled to the mounting features, and further comprising a utility cable coupled to the electronic component and extending through the aperture in the worksurface.

* * * * *